US011848186B2

(12) United States Patent
Booth et al.

(10) Patent No.: US 11,848,186 B2
(45) Date of Patent: Dec. 19, 2023

(54) INNER SOURCE ASSEMBLY AND ASSOCIATED COMPONENTS

(71) Applicant: Micromass UK Limited, Wilmslow (GB)

(72) Inventors: Alastair Booth, Glossop (GB); Alvin Chua, Singapore (SG); Carl Chen, Victoria (AU); Marcus Dawber, Wilmslow (GB); Enchen Guo, Singapore (SG); William Ngo, Singapore (SG); Dennis Ong, Singapore (SG); Richard Tyldesley-Worster, Wilmslow (GB); Arvind Rangan, Singapore (SG)

(73) Assignee: MICROMASS UK LIMITED

( * ) Notice: Subject to any disclaimer, the term of this patent is extended or adjusted under 35 U.S.C. 154(b) by 503 days.

(21) Appl. No.: 17/057,724

(22) PCT Filed: May 31, 2019

(86) PCT No.: PCT/GB2019/051486
§ 371 (c)(1),
(2) Date: Nov. 23, 2020

(87) PCT Pub. No.: WO2019/229445
PCT Pub. Date: Dec. 5, 2019

(65) Prior Publication Data

US 2021/0265154 A1 Aug. 26, 2021

(30) Foreign Application Priority Data

Jun. 1, 2018 (SG) ..... 10201804686T
Jul. 2, 2018 (GB) ..... 1810823

(51) Int. Cl.
*H01J 49/14* (2006.01)
*H01J 27/02* (2006.01)
(Continued)

(52) U.S. Cl.
CPC ..... *H01J 49/147* (2013.01); *H01J 27/024* (2013.01); *H01J 27/205* (2013.01); *H01J 49/26* (2013.01)

(58) Field of Classification Search
CPC ..... H01J 27/022; H01J 27/024; H01J 27/205; H01J 49/147; H01J 49/26
See application file for complete search history.

(56) References Cited

U.S. PATENT DOCUMENTS 5,543,625 A * 8/1996 Johnson ..... H01J 27/20 250/427
5,925,266 A 7/1999 Gagne
(Continued)

FOREIGN PATENT DOCUMENTS

JP 2006294515 A 10/2006
WO 2003079398 A1 9/2003
(Continued)

OTHER PUBLICATIONS

International Search Report and Written Opinion in PCT/GB2019/051486 dated Dec. 5, 2019.
(Continued)

*Primary Examiner* — David E Smith
(74) *Attorney, Agent, or Firm* — Schmeiser, Olsen & Watts LLP

(57) ABSTRACT

An inner source assembly for a mass spectrometer, the assembly comprising: a base; and a volume housing removably connectable to the base for retaining a repeller assembly therebetween, wherein one of the base and volume housing comprises at least two protrusions and the other of the volume housing and base comprises at least two corresponding slots to receive and retain said protrusions, wherein the protrusions are dissimilar to one another and/or the slots are dissimilar to one another.

20 Claims, 17 Drawing Sheets

(51) Int. Cl.
*H01J 27/20* (2006.01)
*H01J 49/26* (2006.01)

(56) References Cited

U.S. PATENT DOCUMENTS

| | | | | |
|---|---|---|---|---|
| 6,239,429 | B1 | 5/2001 | Blessing et al. | |
| 6,448,565 | B1 | 9/2002 | Erath | |
| 6,617,578 | B1 | 9/2003 | Tong | |
| 7,041,984 | B2 | 5/2006 | Ellefson et al. | |
| 7,261,122 | B2 | 8/2007 | Bordonaro et al. | |
| 7,451,778 | B2 | 11/2008 | Bordonaro et al. | |
| 7,467,640 | B2 | 12/2008 | Bordonaro et al. | |
| 7,709,790 | B2 * | 5/2010 | Guckenberger | H01J 49/04 250/281 |
| 8,330,101 | B2 | 12/2012 | Seyfarth | |
| 8,759,757 | B2 | 6/2014 | Hardman et al. | |
| 8,916,821 | B2 | 12/2014 | Ferrara et al. | |
| 9,053,913 | B2 * | 6/2015 | Ferrara | H01J 49/04 |
| 9,263,243 | B2 | 2/2016 | Ferrara et al. | |
| 9,349,580 | B2 | 5/2016 | Ferrara | |
| 9,653,274 | B2 | 5/2017 | Ferrara et al. | |
| 9,927,407 | B2 | 3/2018 | Errara et al. | |
| 10,026,599 | B2 | 7/2018 | Takats et al. | |
| 2008/0087219 | A1 | 4/2008 | Horsky | |
| 2008/0230713 | A1 | 9/2008 | Huang et al. | |
| 2009/0242747 | A1 | 10/2009 | Guckenberger et al. | |
| 2011/0085852 | A1 | 4/2011 | Ferrara | |
| 2014/0291544 | A1 | 10/2014 | Hardman et al. | |
| 2016/0254132 | A1 | 9/2016 | Ferrara et al. | |
| 2017/0016856 | A1 | 1/2017 | Zhang et al. | |
| 2017/0053787 | A1 | 2/2017 | Ferrara | |
| 2017/0207054 | A1 | 7/2017 | Colvin et al. | |
| 2018/0038838 | A1 | 2/2018 | Karancsi et al. | |
| 2018/0042582 | A1 | 2/2018 | Pringle et al. | |
| 2018/0042583 | A1 | 2/2018 | Pringle et al. | |
| 2018/0047551 | A1 | 2/2018 | Jones et al. | |
| 2018/0047553 | A1 | 2/2018 | Richardson et al. | |
| 2018/0047555 | A1 | 2/2018 | Pringle et al. | |
| 2018/0049643 | A1 | 2/2018 | Balog et al. | |
| 2018/0053644 | A1 | 2/2018 | Jones et al. | |
| 2018/0057852 | A1 | 3/2018 | Takats et al. | |
| 2018/0059119 | A1 | 3/2018 | Tak Ts et al. | |
| 2018/0059126 | A1 | 3/2018 | Jones et al. | |
| 2018/0103935 | A1 | 4/2018 | Pringle et al. | |

FOREIGN PATENT DOCUMENTS

| | | | |
|---|---|---|---|
| WO | 2005114701 | A2 | 12/2005 |
| WO | 2006105104 | A1 | 10/2006 |
| WO | 2009018231 | A2 | 2/2009 |
| WO | 2009123914 | A1 | 10/2009 |
| WO | 2011044409 | A1 | 4/2011 |
| WO | 2011046897 | A1 | 4/2011 |
| WO | 2013012834 | A1 | 1/2013 |
| WO | 2016142669 | A1 | 9/2016 |
| WO | 2016142674 | A1 | 9/2016 |
| WO | 2016142675 | A1 | 9/2016 |
| WO | 2016142679 | A1 | 9/2016 |
| WO | 2016142681 | A1 | 9/2016 |
| WO | 2016142683 | A1 | 9/2016 |
| WO | 2016142685 | A1 | 9/2016 |
| WO | 2016142686 | A1 | 9/2016 |
| WO | 2016142689 | A1 | 9/2016 |
| WO | 2016142690 | A1 | 9/2016 |
| WO | 2016142691 | A1 | 9/2016 |
| WO | 2016142692 | A1 | 9/2016 |
| WO | 2016142693 | A1 | 9/2016 |
| WO | 2016142694 | A1 | 9/2016 |
| WO | 2016142696 | A1 | 9/2016 |

OTHER PUBLICATIONS

Combined Search and Examination Report in UK Patent Application No. GB1907753.6 dated Oct. 31, 2019.
Combined Search and Examination Report in UK Patent Application No. GB2008567.6 dated Jul. 30, 2020.
Combined Search and Examination Report in UK Patent Application No. GB2000973.4 dated May 15, 2020.
Search Report in UK Patent Application No. GB1810823.3 dated Apr. 15, 2019.
Combined Search and Examination Report in UK Patent Application No. GB1810823.3 dated Dec. 24, 2018.

* cited by examiner

INNER SOURCE ASSEMBLY AND ASSOCIATED COMPONENTS

BACKGROUND TO THE INVENTION

The present invention relates to an inner source assembly and associated components, including a repeller assembly, an ionisation arrangement, a wiring mount, a mass spectrometer assembly and an inner source handle assembly.

Gas chromatography (GC) is a well-known analytical separation technique. A column containing a stationary phase is arranged in a GC oven. A sample is introduced into the column along with a mobile phase (carrier gas) and heated by the GC oven. The sample interacts with the stationary phase in the column and the components of the sample elute from the end of the column at different rates depending on their chemical and physical properties and affinity to the stationary phase. The mobile phase may comprise, for example, an inert or non-reactive gas such as helium or nitrogen.

It is known to interface the GC oven with a mass spectrometer (MS)—a so-called GC/MS system arrangement—for analysis of the separated components of the sample.

Generally speaking, a mass spectrometer comprises an ion source, a mass analyser and a detector. There are different types of ion sources. The ion source of a mass spectrometer of the type referred to in this specification includes an inner source assembly and an outer source assembly. The incoming components (GC eluent) of the sample from the GC are first introduced into the inner source assembly. Here, they are ionised by an ion source, upon colliding with electrons emitted by one or more filaments and are then emitted towards the outer source assembly which guides the ions through a series of ion lenses (extraction lens stack) towards an analyser and detector of the mass spectrometer. The extraction lens stack is typically secured to the analyser housing. In use, the inner source assembly mates with the outer source assembly.

The inner source may adopt one of a number of types of ion source, including electron ionisation (EI) and chemical ionisation (CI). The sample enters the ion source from the gas chromatography column into a volume of an inner source housing adjacent one or more filaments. Electrons emitted by the filament(s) interact with the sample molecules which serve to ionise them. A charged repeller then repels the positive ions towards the lens stack of the outer source assembly.

Aspects of the inventions disclosed herein relate generally to improvements to the various components of the inner source assembly. The terms 'inner source' and 'outer source' are used herein, in line with the above general definition, to increase clarity. Nevertheless, the respective components of the inner and outer source assemblies are likewise components of the source assembly as a whole.

Mass spectrometers are highly sensitive and accurate pieces of apparatus, and require regular maintenance and cleaning in order to maintain their optimal conditions of operation. It is beneficial if at least some of the maintenance can be carried out by a lab technician, on site, using conventional tools (if any). There is a desire to ensure that the maintenance is as straightforward as possible, reducing the opportunities for errors, minimising down time of the apparatus, and ensuring that the mass spectrometer operates effectively when reassembled.

Likewise, there is a desire to ensure that the manufacture and assembly of the mass spectrometer is simplified as much as possible.

SUMMARY OF THE INVENTION

Accordingly, one aspect of the present invention provides an inner source assembly for a mass spectrometer, the assembly comprising:

a base; and a volume housing removably connectable to the base for retaining a repeller assembly therebetween, wherein one of the base and volume housing comprises at least two protrusions and the other of the volume housing and base comprises at least two corresponding slots to receive and retain said protrusions, wherein the protrusions are dissimilar to one another and the slots are dissimilar to one another.

In at least one embodiment, a first protrusion is longer than a second protrusion. In at least one embodiment, a first protrusion has a greater width than a second protrusion. In at least one embodiment, the proximal end of each protrusion is threaded and received in a threaded aperture in the base or volume housing. In at least one embodiment, the thread on the proximal end of a first protrusion is different to the thread on the proximal end of a second protrusion.

In at least one embodiment, the thread on the proximal end of a first protrusion is clockwise and the thread on the proximal end of the second protrusion is counter clockwise. In at least one embodiment, the pitch of the thread on the proximal end of a first protrusion is different to the pitch of the thread on the proximal end of a second protrusion. In at least one embodiment, the protrusions are integrally formed on the volume housing. In at least one embodiment, the slots extend longitudinally from an axial end face of the volume housing or base and each slot comprises a mouth. In at least one embodiment, the mouth of a first slot is wider than the mouth of a second slot. In at least one embodiment, the mouth of a first slot is wider than a first protrusion and narrower than a second protrusion. In at least one embodiment, the base comprises a female part and the volume housing comprises a male part at least partly receivable in the female part of the base. In at least one embodiment, the at least two radially extending protrusions are provided on the male part and the at least two corresponding slots are provided on the female part. In at least one embodiment, at least an upper portion of the base is generally cylindrical and comprises a wall in which said slots are provided. In at least one embodiment, the at least two slots are generally L-shaped bayonet slots. In at least one embodiment, the slots comprise a first section extending generally longitudinally, a second section extending generally perpendicularly to the first section, and a third section extending generally longitudinally. In at least one embodiment, the second section further comprises a detent. In at least one embodiment, the inner source assembly further comprises a resilient member to bias the base and volume housing away from one another. In at least one embodiment, the protrusion is a pin.

Another aspect of the present invention provides a repeller assembly comprising:

a repeller comprising a shaft; and a repeller holder comprising an aperture for receiving at least part of the shaft of the repeller, wherein said shaft and/or repeller holder comprise corresponding keying features to prevent rotational movement of the repeller relative to the repeller holder.

In at least one embodiment, one of the shaft and aperture is provided with at least one longitudinal protrusion receivable in at least one corresponding channel provided on the other of the aperture and shaft. In at least one embodiment, said shaft and/or repeller have a single plane of symmetry, or no plane of symmetry. In at least one embodiment, the shaft and/or aperture is/are non-cylindrical. In at least one embodiment, the shaft and/or aperture comprises a substantially cylindrical surface is/are provided with at least one flat portion. In at least one embodiment, the shaft and aperture comprise substantially the same cross section. In at least one embodiment, the repeller holder is comprised of substantially thermally and electrically insulating material. In at least one embodiment, the shaft of the repeller is threaded. In at least one embodiment, there is further provided a repeller rod having a threaded aperture to receive the threaded shaft of the repeller therein. In at least one embodiment, there is further provided an ionisation chamber, in which at least a part of the repeller and repeller holder is received.

Another aspect of the present invention provides a repeller assembly comprising:

a thermally and electrically insulating repeller holder comprising an aperture;

a repeller received in the aperture of the repeller holder; and an ionisation chamber comprising an aperture, the repeller holder received in the aperture of the ionisation chamber such that the repeller is substantially thermally and electrically insulated from the ionisation chamber.

Another aspect of the present invention provides an ionisation arrangement comprising: a volume housing comprising an aperture; and an ionisation chamber having an outer surface and being receivable in said aperture, wherein said aperture and/or outer surface is configured such that the ionisation chamber is only receivable in the aperture in a single rotational orientation.

In at least one embodiment, the aperture and/or outer surface has/have a single plane of symmetry.

In at least one embodiment, the aperture and/or outer surface has/have no plane(s) of symmetry.

In at least one embodiment, the aperture and/or outer surface is non-cylindrical.

In at least one embodiment, the aperture and/or outer surface comprises a substantially cylindrical surface provided with at least one flat portion.

In at least one embodiment, the aperture and/or outer surface comprise substantially the same cross section.

Another aspect of the present invention provides an ionisation arrangement kit, comprising: a first volume housing comprising an aperture of a first cross-section;

a second volume housing comprising an aperture of a second cross-section;

a first ionisation chamber having an outer surface substantially of the first cross-section; and a second ionisation chamber having an outer surface substantially of the second cross-section, wherein the first and second cross-sections are dissimilar such that only the first ionisation chamber is receivable in the aperture of the first volume housing and only the second ionisation chamber is receivable in the aperture of the second volume housing.

In at least one embodiment, the volume housing is comprised of aluminium bronze.

In at least one embodiment, the ionisation chamber is comprised of stainless steel.

Another aspect of the present invention provides a source assembly comprising a source block and an ionisation arrangement.

In at least one embodiment, the source block and volume housing of the ionisation arrangement are comprised of dissimilar materials.

In at least one embodiment, the source block is comprised of aluminium.

Another aspect of the present invention provides an inner source assembly for a mass spectrometer, comprising:

a repeller;

at least one filament assembly; and an inner source interface panel comprising a plurality of terminals electrically connectable to said repeller and said at least one filament assembly, the terminals for electrical connection with corresponding terminals on a mass spectrometer housing in use.

Another aspect of the present invention provides a mass spectrometer assembly comprising an inner source assembly; and a mass spectrometer housing for receiving the inner source assembly and comprising a mass spectrometer interface panel comprising a plurality of corresponding terminals, the assembly configured such that when the inner source assembly is received in the mass spectrometer housing the terminals of the source interface panel electrically contact the corresponding terminals of the mass spectrometer interface panel, for the transfer of power and/or control signals to said inner source assembly.

In at least one embodiment, the terminals of at least one of the inner source interface panel and mass spectrometer interface panel comprise resilient pins.

In at least one embodiment, the terminals of the other of the mass spectrometer interface panel and source interface panel comprising contact pads to electrically contact said pins.

In at least one embodiment, the assembly is configured such that electrical connection between the inner source interface panel and mass spectrometer interface panel is broken when the inner source assembly is detached from the mass spectrometer housing.

In at least one embodiment, the assembly is configured such that electrical connection between the source interface panel and mass spectrometer interface panel is established when the inner source assembly is secured to the mass spectrometer housing.

In at least one embodiment, at least one of the terminals comprises a pogo pin.

In at least one embodiment, the terminals of the source interface panel comprise pogo pins and the terminals of the mass spectrometer interface panel comprise recessed electrical pads.

Another aspect of the present invention provides an inner source assembly for a mass spectrometer, comprising:

a base comprising a plurality of electrical terminals; and a volume housing movably retained on the base for retaining a repeller assembly therebetween and comprising a plurality of corresponding electrical terminals, the volume housing movable between a first axial position relative to the base in which the respective electrical terminals are not connected, and a second position relative to the base in which the respective electrical terminals are connected to one another; and a biasing element urging the volume housing into the first position.

Another aspect of the present invention provides a wiring mounting plate comprising a plurality of apertures, each to receive a terminal connector of a corresponding plurality of wires in use, the apertures configured to retain the terminal connectors in a substantially parallel configuration.

In at least one embodiment, the mounting plate further comprises a plurality of channels, joining a respective aperture to the outer radial surface of the mounting plate, for insertion of the wire.

In at least one embodiment, the width of the channel is narrower than the diameter of the aperture.

Another aspect of the present invention provides an inner source wiring assembly comprising the wiring mounting plate and a plurality of wires, at least a first end of each wire provided with a terminal connector.

In at least one embodiment, the diameter of the terminal connector is larger than the diameter of the wire.

In at least one embodiment, the diameter of the channel is smaller than the diameter of the terminal connector.

In at least one embodiment, the mounting plate is comprised of a substantially electrically and thermally insulating material.

Another aspect of the present invention provides a mass spectrometer assembly comprising:

an inner source assembly; and a mass spectrometer housing having an aperture for receiving the inner source assembly therein, wherein one of the inner source assembly and mass spectrometer housing comprises at least one rail and the other of the mass spectrometer housing and inner source assembly comprises at least one channel for receiving the at least one rail.

In at least one embodiment, the side surfaces of the at least one rail are not parallel to one another.

In at least one embodiment, the side surfaces of the at least one channel are not parallel to one another.

In at least one embodiment, the side surfaces of at least one rail are linear.

In at least one embodiment, the side surfaces of at least one channel are linear.

In at least one embodiment, the side surfaces of the at least one rail are non-linear.

In at least one embodiment, the side surfaces of the at least one channel are non-linear.

In at least one embodiment, the mass spectrometer housing comprises a channel provided on the inner surface of the aperture, the width of the channel at a first end adjacent the exterior of the mass spectrometer housing being wider than the width of the channel at a second end adjacent the interior of the mass spectrometer.

In at least one embodiment, the side surfaces of the channel at a first end of the channel adjacent the exterior of the mass spectrometer are not parallel to one another, and the side surfaces of the channel at a second end of the channel adjacent the interior of the mass spectrometer are substantially parallel to one another.

Another aspect of the present invention provides an inner source handle assembly for a mass spectrometer comprising:

a main body comprising a sealing plate;

a handle rotatably mounted to the main body and comprising at least two radially extending wings, the handle movable between a first position spaced from the sealing plate, and a second position in which the handle substantially contacts the sealing plate a resilient element biasing the handle into the first position.

In at least one embodiment, one of the main body and handle comprises at least one protrusion and the other of the handle and main body comprises at least one slot to receive the at least one protrusion, the slot comprising a longitudinal first section to constrain movement of the handle relative to the sealing plate, from the first position to the second position in a longitudinal direction.

In at least one embodiment, the slot further comprises a second section substantially perpendicular to the first section, constraining the handle to rotational movement relative to the main body.

Another aspect of the present invention provides a mass spectrometer assembly comprising:

an inner source handle assembly;

a mass spectrometer housing comprising an aperture for receiving the inner source assembly therein, the housing comprising at least two sockets adjacent the aperture to receive the flanges therein.

Another aspect of the present invention provides a mass spectrometer assembly comprising:

a source assembly comprising a rotatable handle, the handle comprising at least two radially extending wings, a mass spectrometer housing comprising at least two corresponding sockets to receive the wings, wherein the surface of at least one of the wings or sockets comprises a biased protrusion, and the surface of a corresponding one of the sockets and wings comprises a depression to receive the end of the biased protrusion when the wings are received in the sockets.

DESCRIPTION OF THE DRAWINGS

Embodiments of the present invention will now be described, by way of non-limiting example only, with reference to the following figures in which.

DETAILED DESCRIPTION OF EMBODIMENTS OF THE INVENTION

Figure 1:
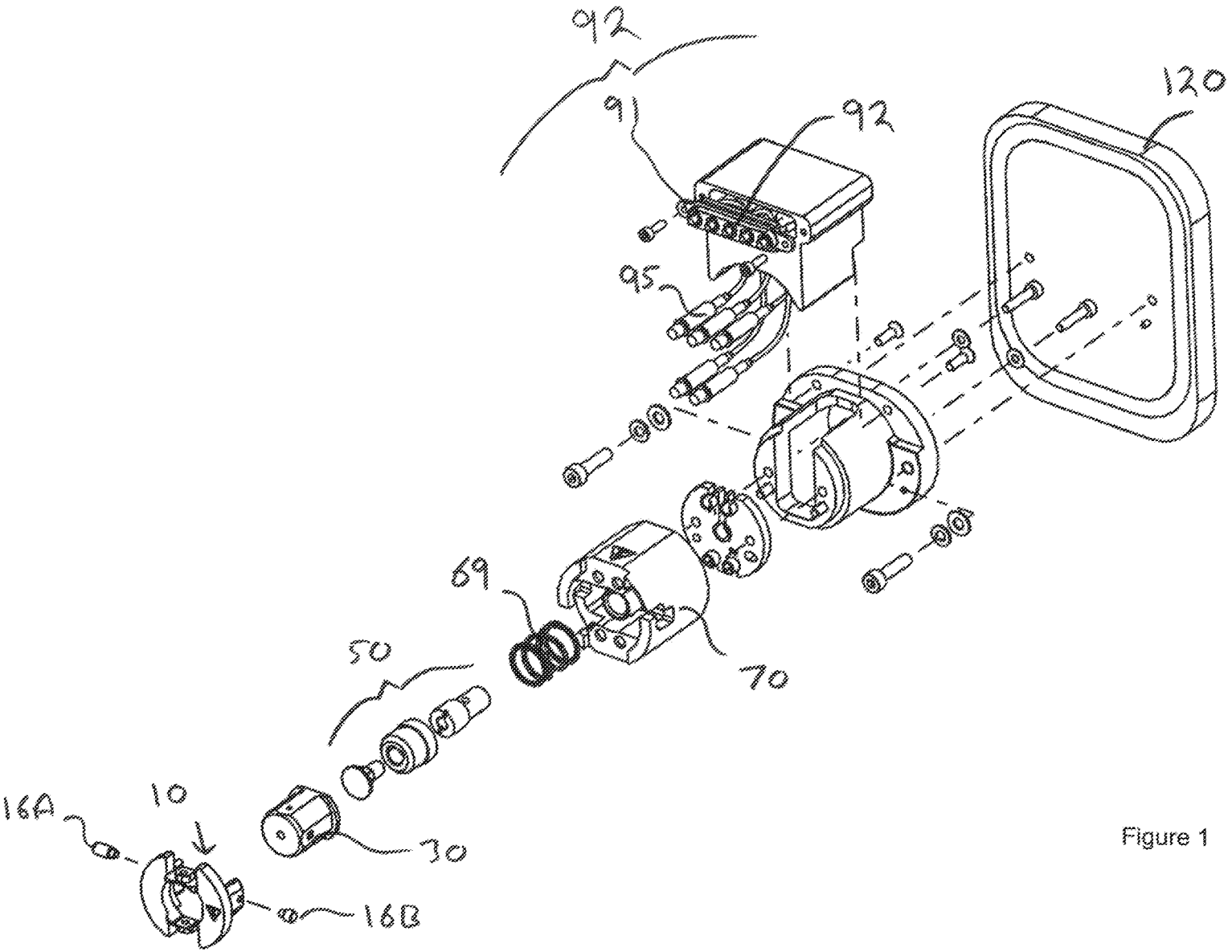
FIG. 1 illustrates an exploded view of an inner source assembly.

FIG. 1 shows an exploded view of part of an inner source assembly 1 of a mass spectrometer incorporating various aspects and embodiments of the present invention.

Figure 8:
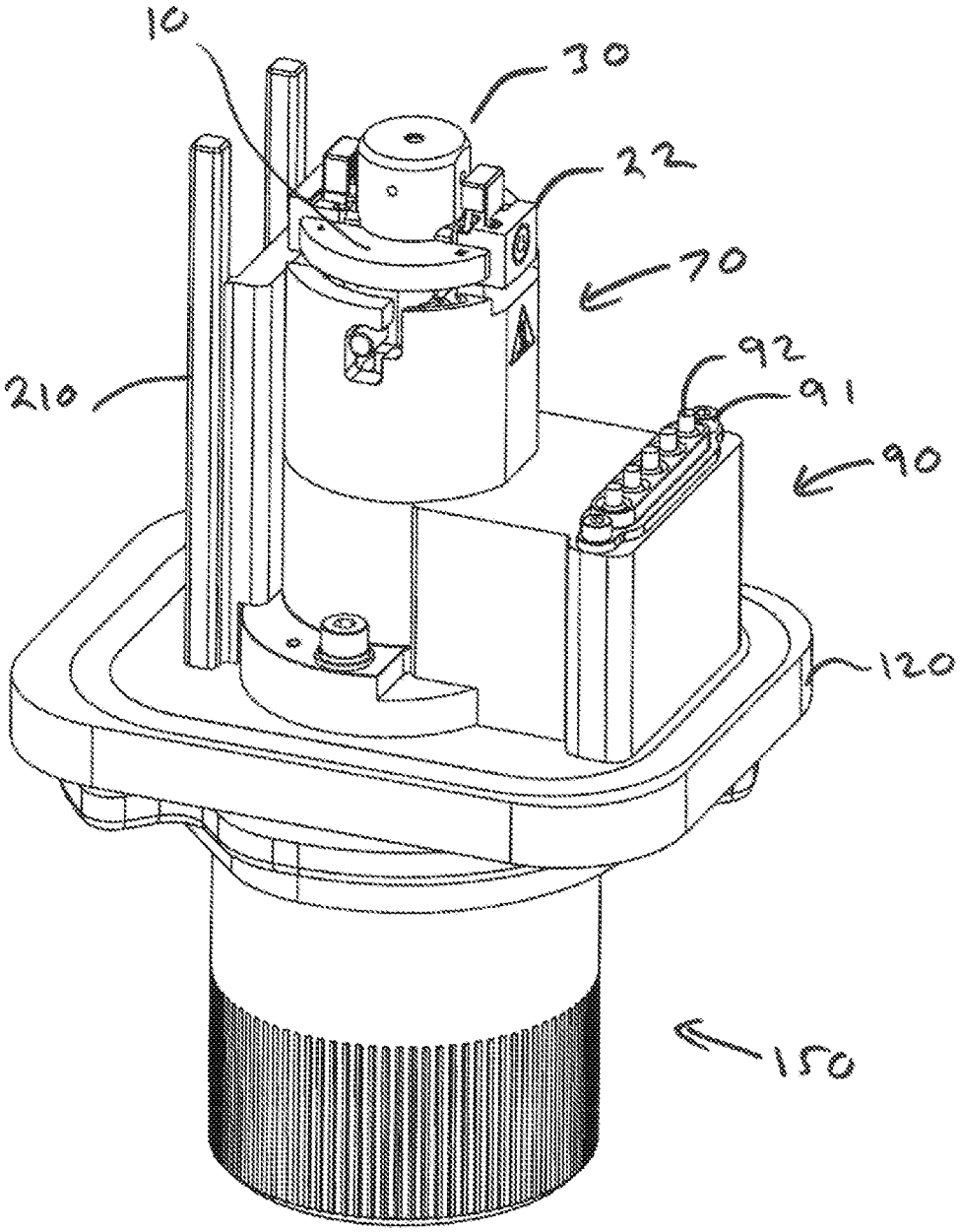
FIG. 8 illustrates an assembled view of the inner source housing with a handle assembly.

The inner source assembly 1 illustrated in FIG. 1 generally comprises a volume housing 10, an ionisation chamber 30, a repeller assembly 50, a resilient element 69, an ionisation chamber base 70, a wiring assembly 90, and a sealing plate 120. The inner source assembly 1 may further comprise a handle assembly 150 on the opposite side of the sealing plate 120 (See FIG. 8).

The features illustrated in FIG. 1 are not all essential. This disclosure relates to various aspects of some of all components and/or assemblies of the inner source assembly, as will now be described.

Dissimilar Protrusions

In one aspect of the present invention, as illustrated in more detail in FIGS. 2 to 7, there is provided an inner source assembly 1 for a mass spectrometer, the assembly 1 comprising a base 70 and a volume housing 10. The base 70 is an ionisation chamber base. The volume housing 10 is removably connectable to the base 70 and, in use, retains a repeller assembly 50 and ionisation chamber 30 therebetween. In at least one embodiment, the volume housing 10 is not rigidly connected to the base 70, but is selectively movable with respect thereto, as will be described below.

In effect, the volume housing 10 is a retaining element, to retain the repeller assembly 50 and ionisation chamber 30 on the base 70, and to act as a mounting for the filament assembly(ies) 22.

Figure 9A:
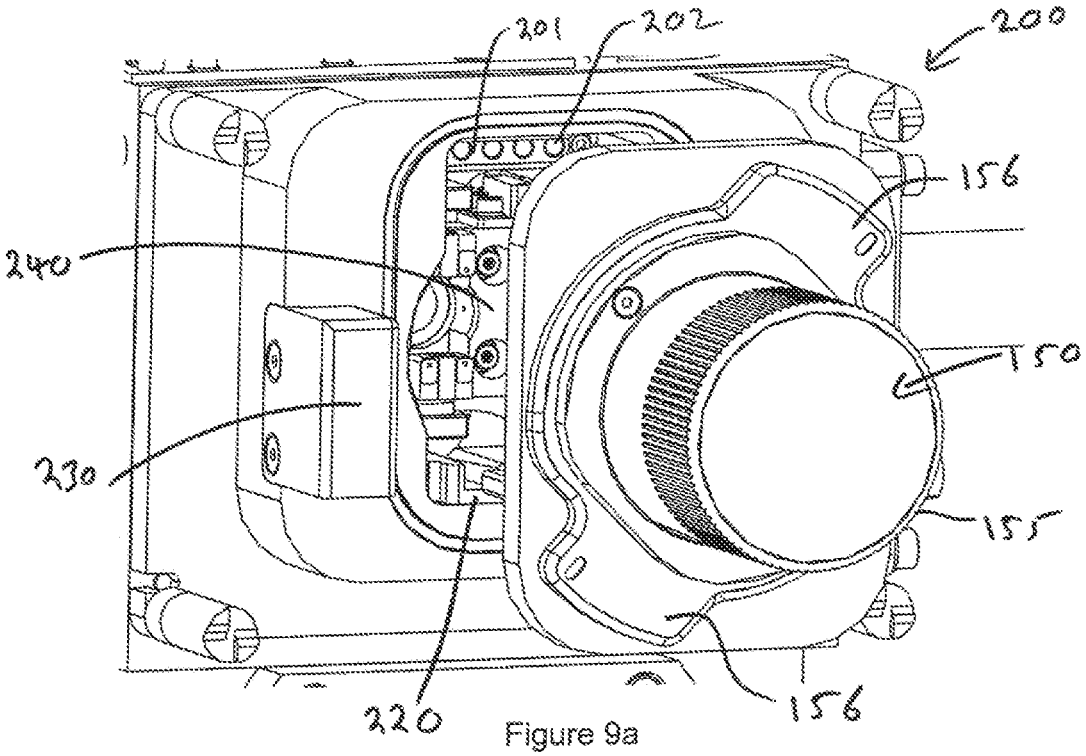
FIGS. 9*a* and 9*b* illustrate the insertion of the inner source housing into a mass spectrometer housing.
Figure 9B:
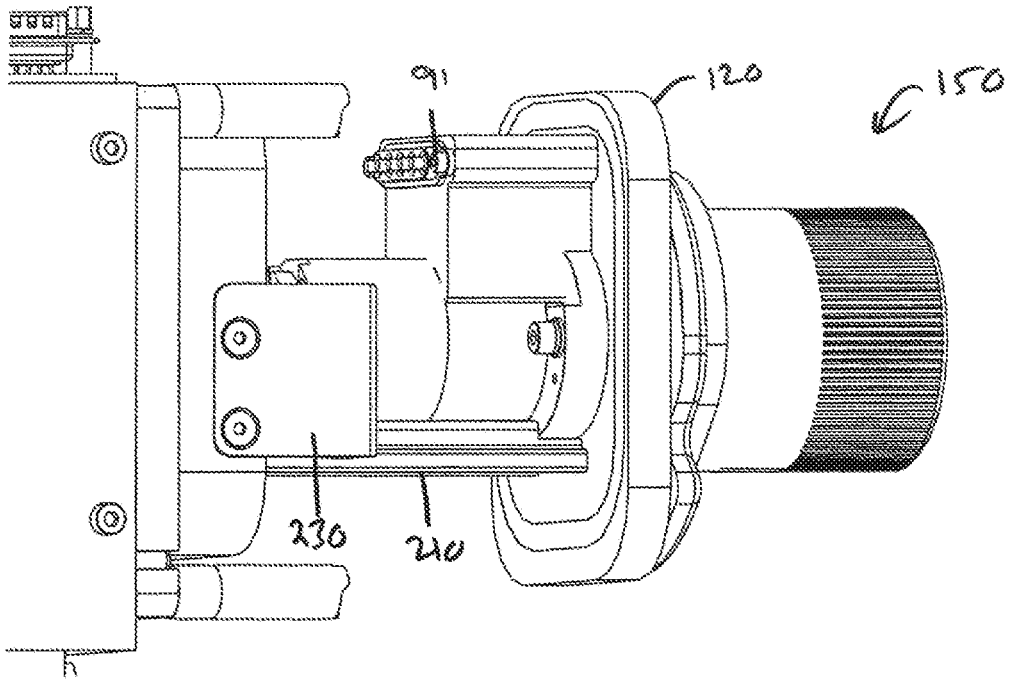

In the embodiment illustrated in FIG. 1, the volume housing 10 comprises a generally planar body 11 having two longitudinally extending arms 12 extending perpendicularly therefrom. The planar body 11 of the volume housing comprises two diametrically opposed wings 13 which in use, contact a heated source block 240 (shown in FIG. 9) of an outer source assembly. The two wings 13 define filament mounting bays 14 therebetween which receive, in use, two filament assemblies 22 (shown in FIGS. 6 and 8). The volume housing 10 illustrated is for an EI source, requiring two filament assemblies. A volume housing for use with a CI source (not shown) may only have a single mounting bay, for a single filament assembly. Alternatively, a volume housing for use with a CI source may have two filament mounting bays, but only a single filament assembly may be installed.

An aperture 15 is defined in the centre of the planar body 11 of the volume housing 10, passing between the arms 12. The centre of the aperture 15 lies substantially on the central axis of the inner source assembly 1.

The two arms 12 extending longitudinally from the planar body 11 together define a male part which is receivable in a female part of the base 70 (described later).

Figure 2:
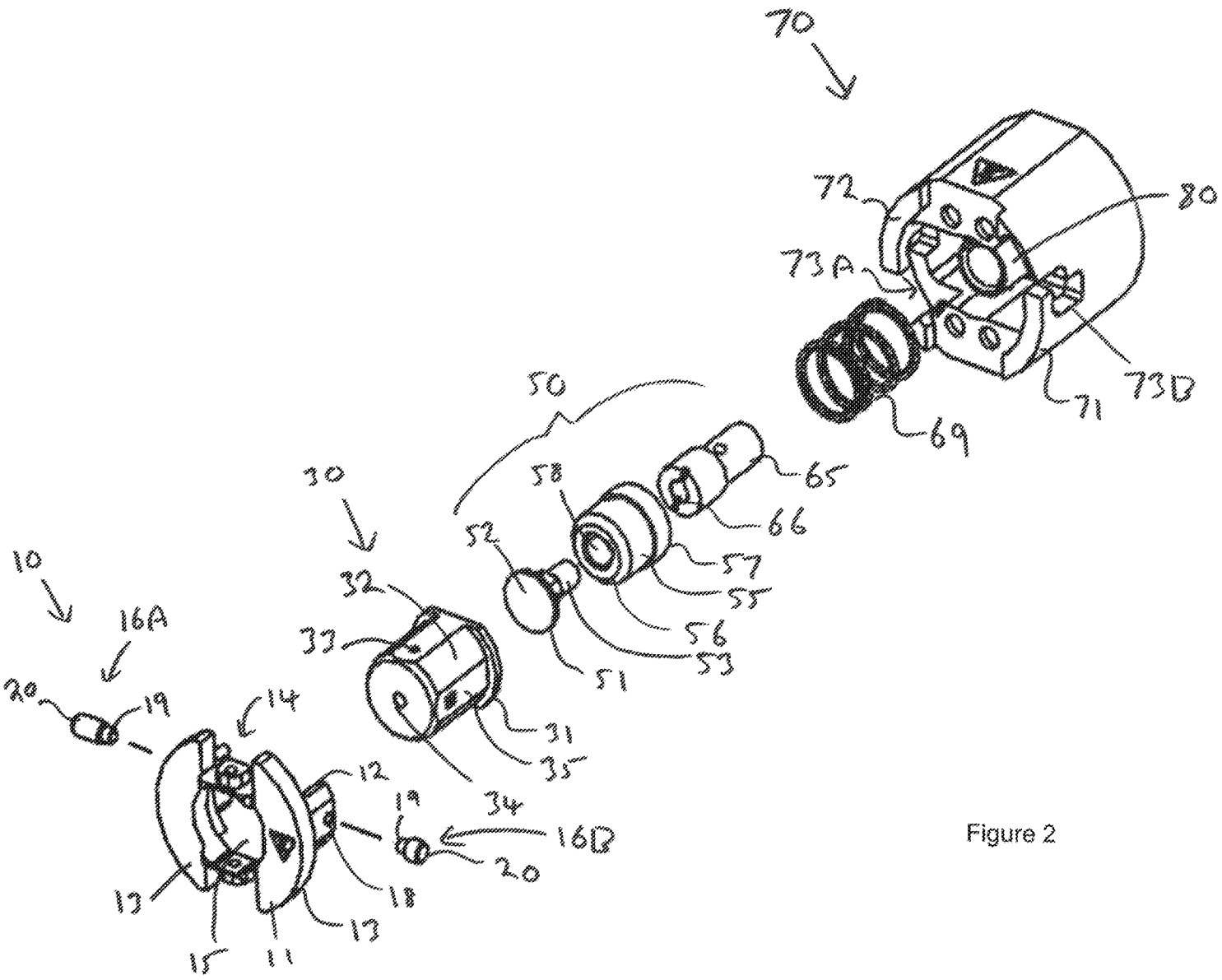
FIG. 2 illustrates an exploded view of a part of the inner source assembly of FIG. 1.

Referring to FIG. 2, the volume housing 10 further comprises two radially extending protrusions 16A, 16B. These protrusions 16A, 16B (shown in FIGS. 5*a*, 6, 7, 8 and exploded in FIGS. 1 and 2) extend radially from the arms 12 of the volume housing 10. The base 70 comprises two corresponding slots 73A, 73B which receive and retain the protrusions 16A, 16B therein. In the embodiment illustrated, the two protrusions 16A, 16B are diametrically opposed from one another. This is not essential. In some embodiments, the protrusions 16A, 16B may be distributed differently on the volume housing 10. There may be more than two radially extending protrusions 16A, 16B. In some embodiments, the protrusions 16A, 16B may extend in a direction other than radially. The number and distribution of the protrusions 16A, 16B on the volume housing 10 corresponds to the number and distribution of the slots 73A, 73B on the base 70.

The protrusions 16A, 16B are dissimilar to one another. Additionally, the slots 73A, 73B are dissimilar to one another. By "dissimilar" may mean that each of the protrusions 16A, 16B and slots 73A, 73B differs from the other of the protrusions 16A, 16B and slots 73A, 73B in at least one physical characteristic. In other words, first protrusion 16A is dissimilar to second protrusion 16B; and first slot 73A is dissimilar to second slot 73B. In at least one embodiment, the physical characteristic is a dimension.

An advantage of the dissimilarity between the protrusions 16A, 16B and the slots 73A, 73B is that the volume housing 10 can only be connected to the base 70 in a single orientation. Effectively, the dissimilarity between the protrusions 16A, 16B and slots 73A, 73B allows for substantially "fool-proof" assembly, preventing the volume housing 10 and the base 70 from being assembled together incorrectly. Consequently, by ensuring the correct angular alignment of the volume housing 10 relative to the base 70, the correct angular alignment between any components associated with the volume housing 10 and/or the base 70 in use can be substantially ensured and maintained.

In at least one embodiment, the arms 12 of the volume housing 10 are provided with threaded apertures 18. The proximal end 19 of each protrusion 16A, 16B may be threaded and received in the corresponding threaded aperture 18 in the arms 12 of the volume housing 10. In at least one embodiment, the thread on the proximal end 19 of a first protrusion 16A is different to the thread on the proximal end 19 of a second protrusion 16B. The threaded apertures 18 in the arms 12 of the volume housing 10 are correspondingly threaded such that the first protrusion 16A is receivable in a first threaded aperture 18 (with a corresponding thread) but not in the second threaded aperture 18 (with a different thread). Consequently, the protrusions 16A, 16B may only be secured in the threaded apertures 18 of the legs 12 in a single combination. An advantage of this arrangement is that it substantially prevents an operator from assembling the arrangement incorrectly.

In at least one embodiment, the thread on the proximal end 19 of a first protrusion 16A is clockwise and the thread on the proximal end 19 of the second protrusion 16B is counter clockwise. Alternatively or additionally, the pitch of the thread on the proximal end 19 of a first protrusion 16A is different to the pitch of the thread on the proximal end 19 of a second protrusion 16B.

Rather than providing a thread on a proximal end 19 of a protrusion 16A, 16B, and a corresponding threaded aperture 18 in the leg 12 of the volume housing 10, other arrangements are possible. For example, the cross-section of the proximal end 19 of a first protrusion 16A may differ to the cross-section of the proximal end 19 of a second protrusion 16B, each to be received in an aperture 18 with a corresponding cross-section, such that the protrusions 16A, 16B may only be received in the apertures 18 in a predetermined combination.

In the embodiment shown, the protrusion 16A, 16B is a pin, of generally cylindrical shape and axially symmetrical.

The pin may be of substantially the same cross-section and diameter along its length, with a threaded portion provided at a proximal end 19.

In another embodiment, the distal end 20 of the pin 16A, 16B has a diameter which is greater than the diameter of the proximal end 19, such that the interface between the proximal 19 and distal 20 ends forms a step which engages with the surface of leg 12 of the volume housing 10 adjacent the threaded aperture 18, in use, when the proximal end 19 is screwed into the threaded aperture 18. An advantage of this arrangement is that the step creates a datum point to ensure that the distal end 20 of the protrusion 16A, 16B extends from the leg 12 (and thus the longitudinal axis of the volume housing 10) by a predetermined distance.

In at least one embodiment, the protrusions 16A, 16B are dissimilar to one another, in a manner additional to any threading provided on the proximal end 19. In at least one embodiment, the distal ends 20 of the protrusions 16A, 16B are dissimilar to one another.

As noted above, by "dissimilar" is meant that the protrusions 16A, 16B differ in at least one physical characteristic. In at least one embodiment, the physical characteristic is a dimension.

In at least one embodiment, a first protrusion 16A is longer than a second protrusion 16B. In at least one embodiment, the first protrusion 16A is between 2 mm and 5 mm longer than the second protrusion 16B. In at least one embodiment, the difference may be 3 mm.

In at least one embodiment, the distal end 20 of the first protrusion 16A is further from the longitudinal axis of the inner source assembly 1 (i.e. the centre of the aperture 15) than the distal end 20 of the second protrusion 16B. In one embodiment, the distance between distal end of the first protrusion 16A and the longitudinal axis of the inner source assembly 1 is 20 mm, and the distance between the distal end 20 of the second protrusion 16B and the longitudinal axis of the inner source assembly 1 is 17 mm.

Alternatively or additionally, the first protrusion 16A has a greater width than the second protrusion 16B. In at least one embodiment, the protrusion 16A, 16B is a pin having a diameter, and the first protrusion 16A has a greater diameter than a second protrusion 16B.

In at least one embodiment where there are three or more protrusions 16A, 16B, at least two of the protrusions are dissimilar to one another.

In the embodiments illustrated and described above, the protrusions 16A, 16B are discrete from the volume housing 10, and secured thereto. This is not essential. The protrusions 16A, 16B may be integrally formed with the volume housing 10 and/or arranged not to be removable.

Referring to FIG. 2, an upper portion of the ionisation chamber base 70 comprises an upstanding cylindrical wall 71. A cavity is formed within the upper portion which defines a female part of the ionisation chamber base 70 for receiving at least a part of the male part of the volume housing 10 (e.g. the legs 12).

The wall 71 of the upper portion of the base 70 is of a predetermined thickness around at least a part of the upper portion, and comprises an axial end face 72.

Figure 3:
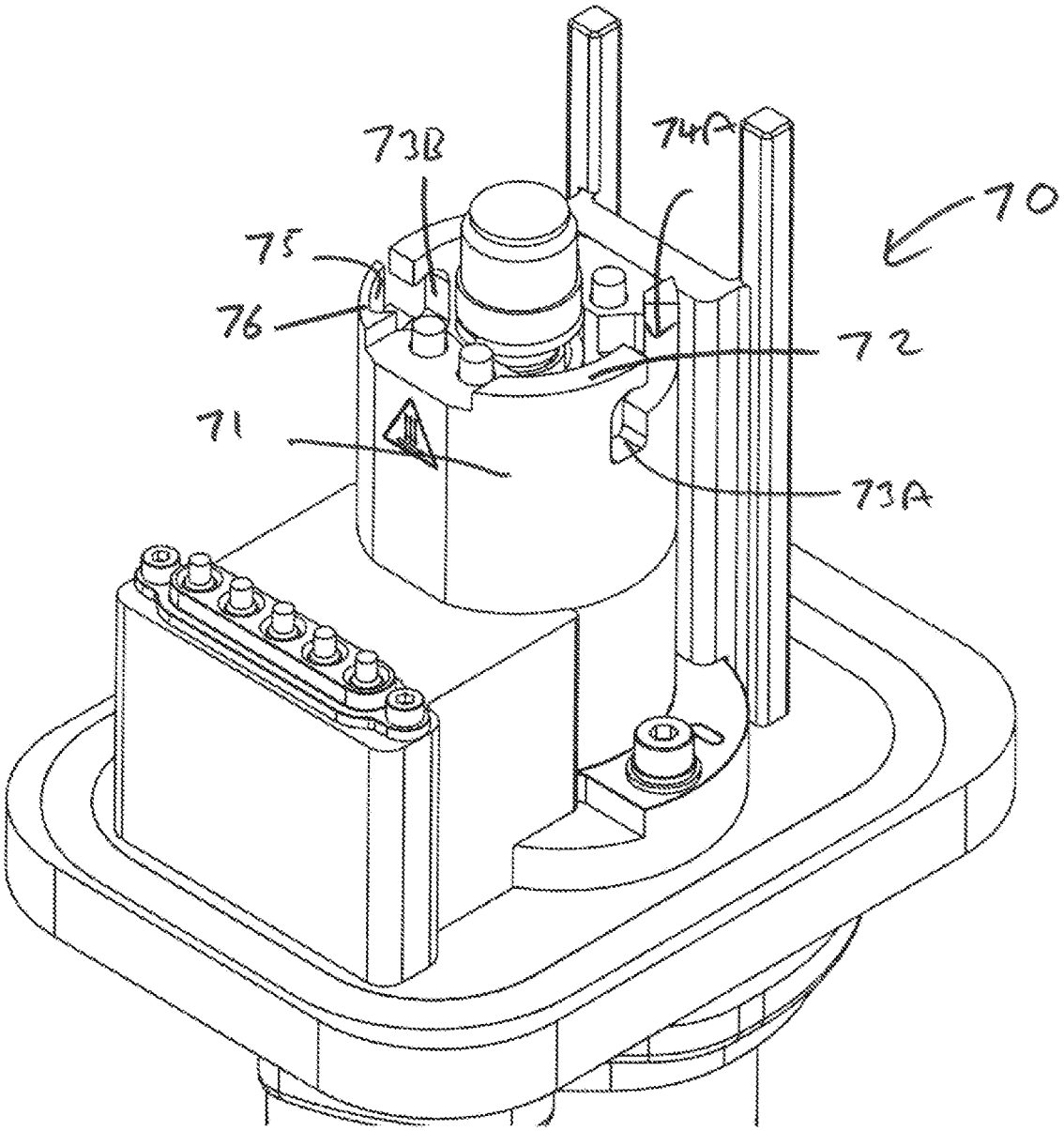
FIG. 3 illustrates the ionisation chamber base with an ionisation chamber and repeller assembly located therein.

Referring to FIG. 3, at least two slots 73A and 73B are provided on the ionisation chamber base 70. In at least one embodiment, the slots 73A, 73B are diametrically opposed. Each slot 73A, 73B comprises a mouth 74A, 74B adjacent the axial end face 72, and each slot 73A, 73B extends away from the mouth 74A, 74B into the cylindrical upper wall 71 of the base 70. The width of the mouth 74A, 74B of a slot 73A, 73B may differ to the width of the rest of the slot 73A, 73B.

In at least one embodiment, the mouth 74A of a first slot 73A is wider than the mouth 74B of a second slot 73B. In at least one embodiment, the mouth 74A of the first slot 73A is wider than the first protrusion 16A but narrower than the second protrusion 16B. Consequently, only the first protrusion 16A is receivable in the mouth 74A of the first slot 73A. Insertion of the second 16B, wider, protrusion into the first slot 73A is prevented. Consequently, the volume housing 10 cannot be further inserted into the ionisation chamber base 70.

In the embodiment illustrated in FIGS. 1 to 7, each of the first 73A and second 73B slots extends from the outer surface of the cylindrical wall 71 through to the inner surface of the cylindrical wall 71.

Figure 7:
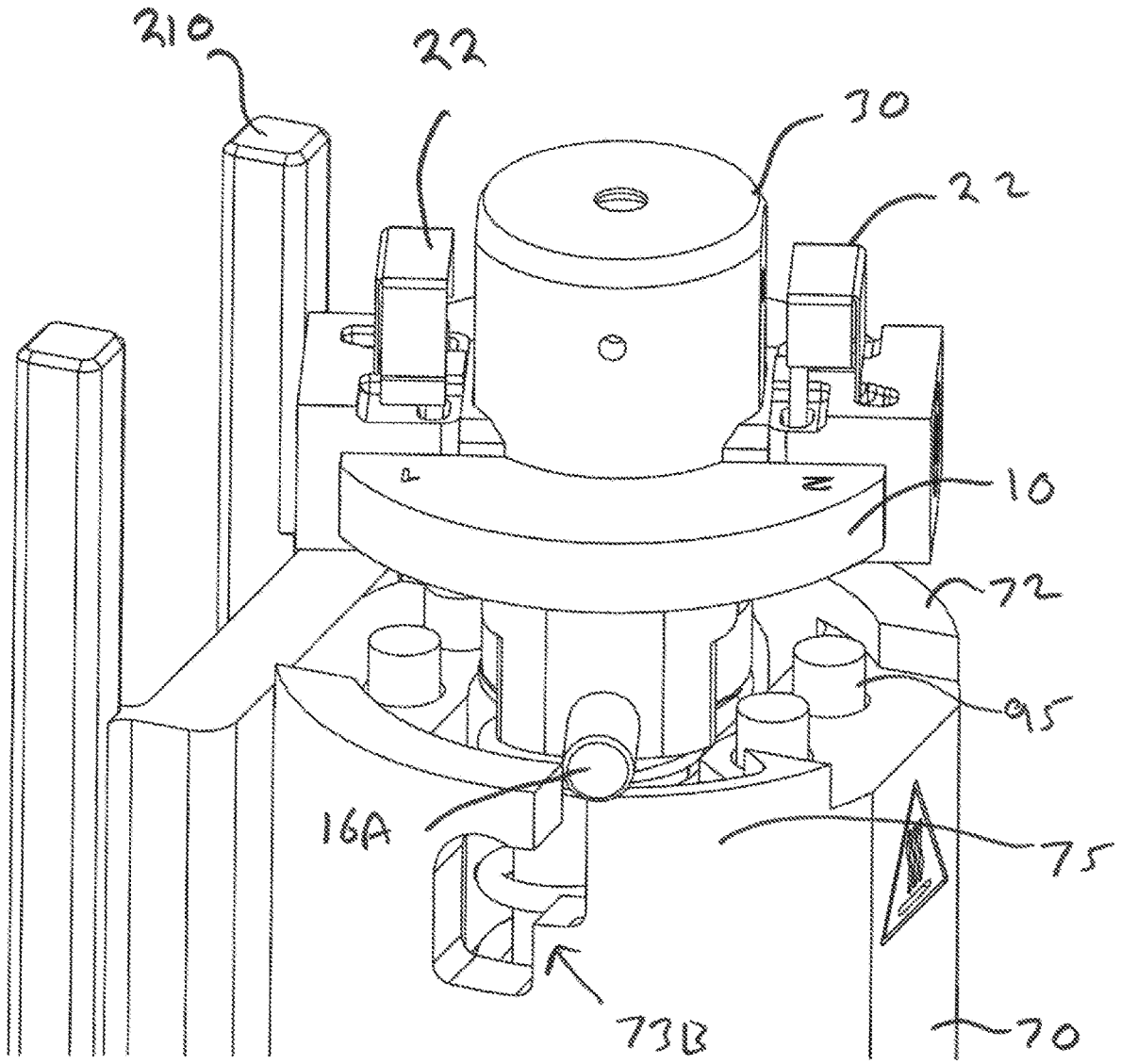
FIG. 7 illustrates the incorrect assembly of the volume housing into the slots of the base.

In at least one embodiment, a guard 75 (FIGS. 3 and 4) is associated with the mouth 74B of the second slot 73B, which serves to obstruct at least a part of the mouth 74B of the second slot, 73B thereby reducing the width of the second slot 73B. The guard 75 presents an inner radial surface 76. In the embodiment illustrated, the distance between the inner surface 76 of the guard 75 and the longitudinal axis of the base 70 is greater than the length of the second protrusion 16B but smaller than the length of the first protrusion 16A. Consequently, if a user attempts to insert the first (longer) protrusion 16A into the mouth 74B of the second slot 73B, the distal end 20 of the first protrusion 16A will impact against the upper surface of the guard 75, substantially preventing the insertion of the first protrusion 16A into the mouth 74B of the second slot 73B as illustrated in FIG. 7. Additionally, the width of the mouth 74B as reduced by the guard 75 is smaller than the diameter of the first protrusion 16A.

However, if the volume housing 10 is rotated about its longitudinal axis by 180 degrees, the first protrusion 16A is offered up to the mouth 74A of the first slot 73A and the second protrusion 16B is offered up to the mouth 74B of the second slot 73B, which is the correct orientation, then engagement of the volume housing 10 and base 70 becomes possible. Since the distance between the inner surface 76 of the guard 75 and the longitudinal axis of the base 70 is greater than the length of the second protrusion 16B, the second protrusion 16B is able to be received in the second slot 73B without it impacting on the guard 75. The first protrusion 16A is able to be received in the first slot 73A (without any guard).

Although in the embodiment shown, at least part of the first slot 73A passes through the cylindrical wall 71 of the upper part of the base 70, this is not essential. The slots 73A, 73B may be at least partially "blind" and not pass through the entirety of the upper wall 71 of the base 70.

In some embodiments, the first 73A and second 73B slots may be provided on an inner cylindrical surface of the upper part of the base, and the radial distance from the inner surface of the first 73A and second 73B slots from the longitudinal axis of the base 70 may differ.

Figure 4A:
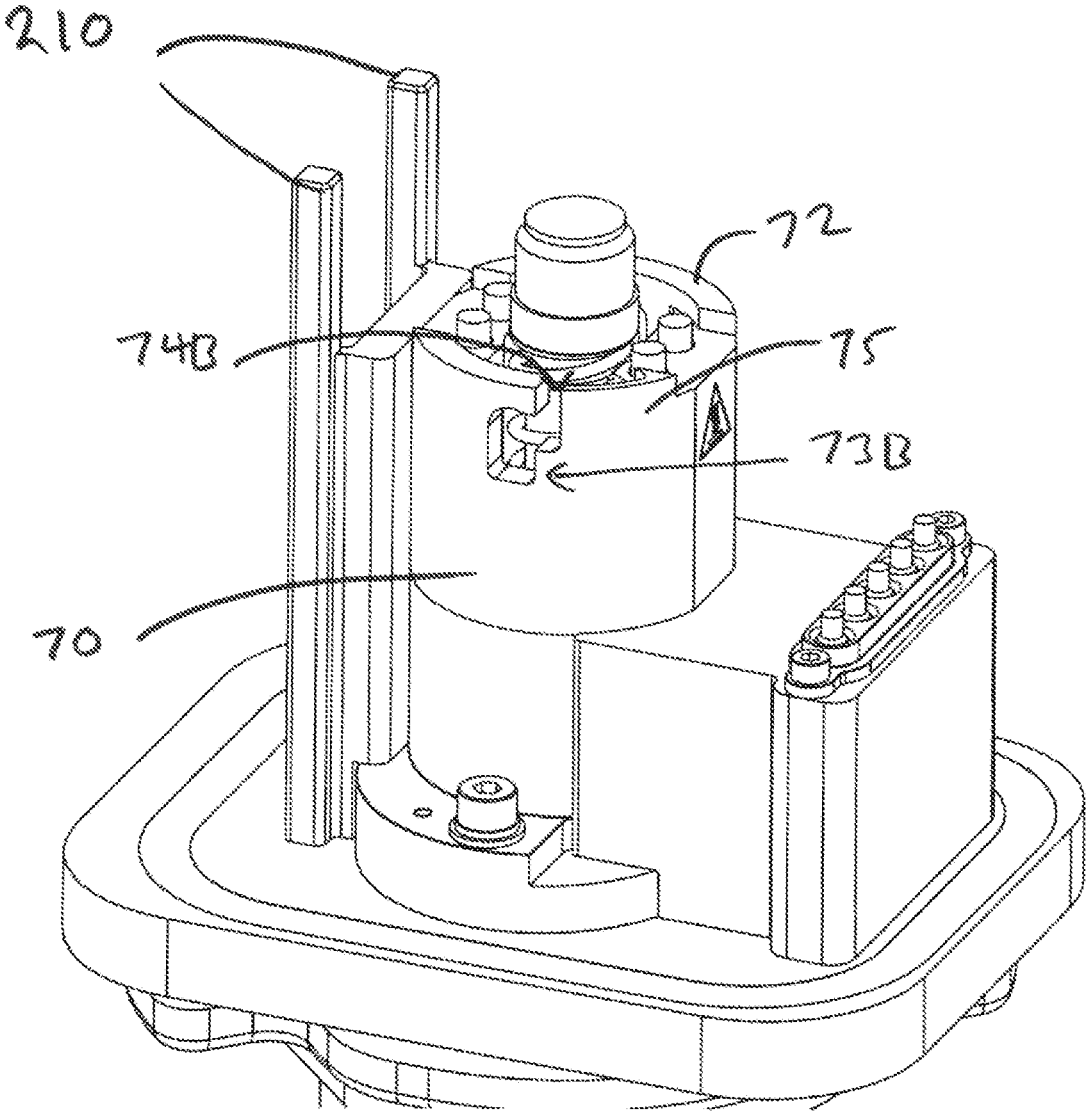
FIG. 4 illustrates the arrangement of FIG. 3 from a different angle, showing a second slot.
Figure 4B:
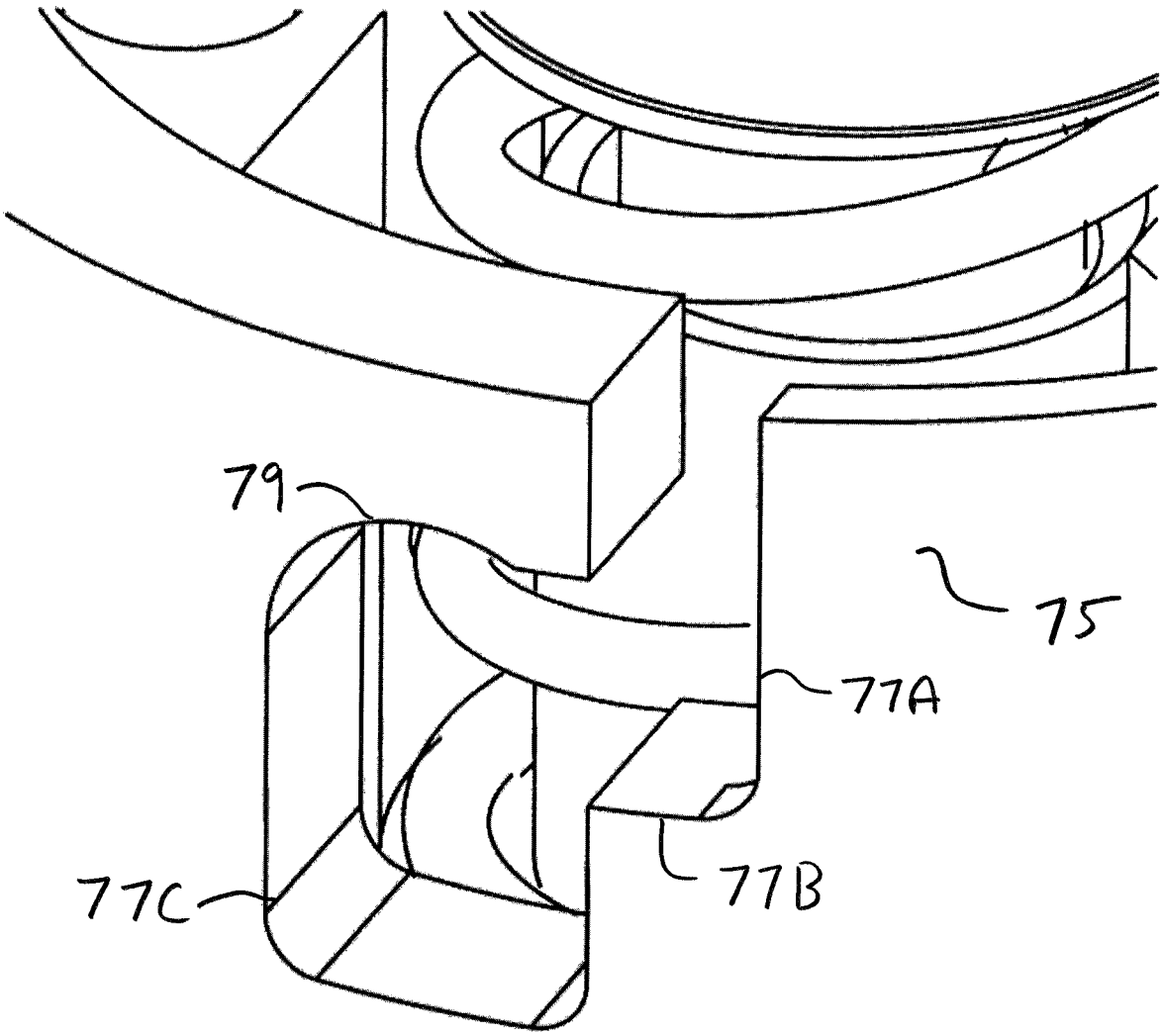
Figure 5A:
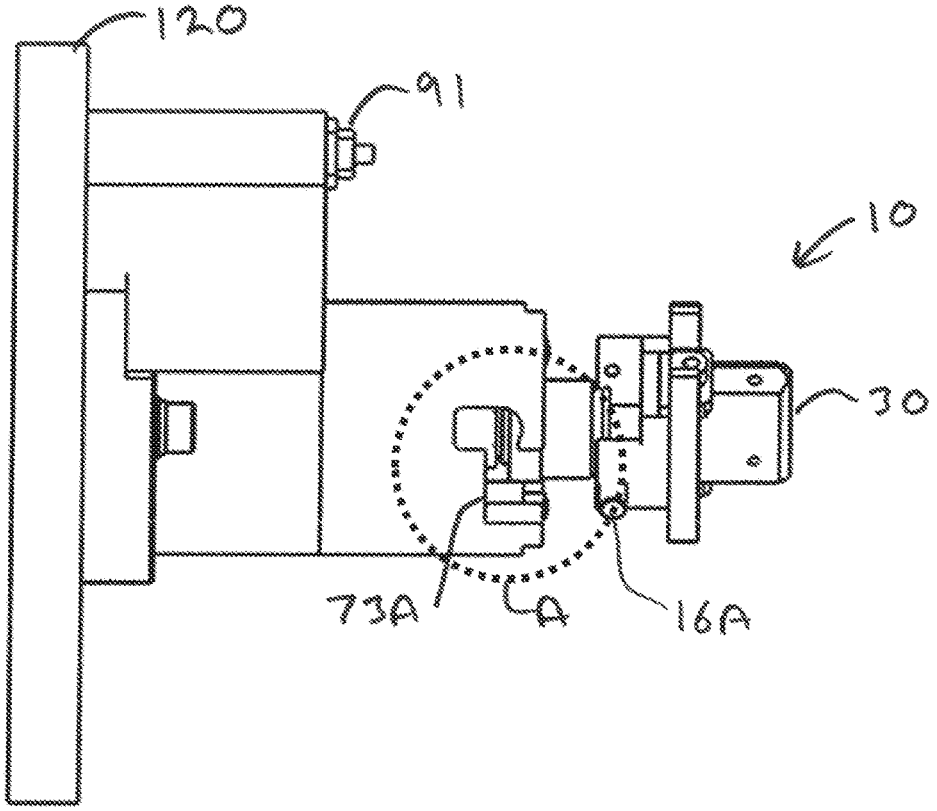
FIG. 5*a* illustrates a side view of an inner source assembly during assembly.
Figure 5B:
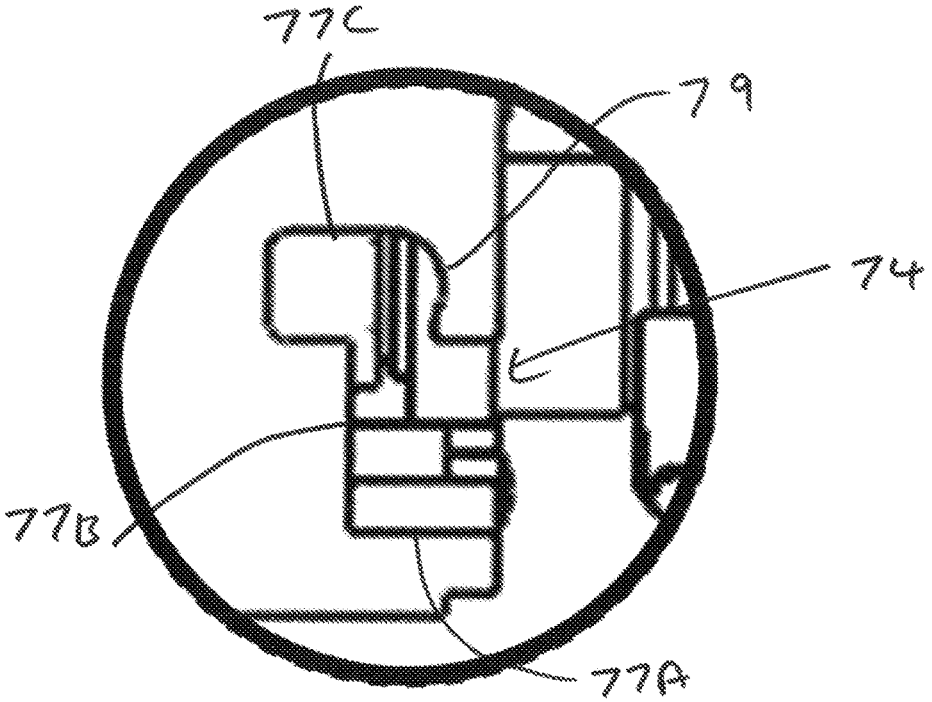
FIG. 5*b* shows an enlarged view of detail A from FIG. 5*a;*
Figure 6:
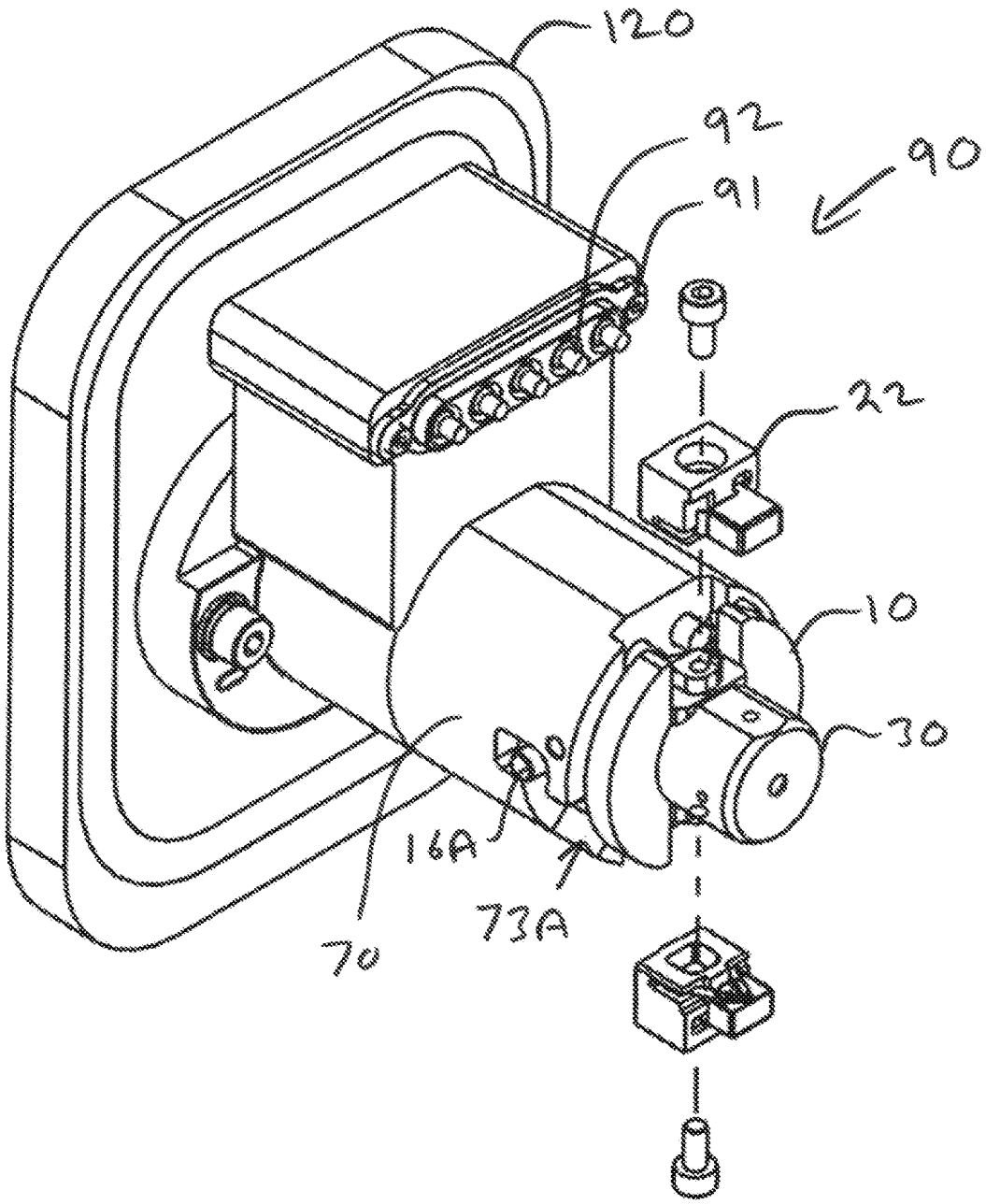
FIG. 6 illustrates the assembly of the volume housing into the base.

Referring to FIG. 4, the slots 73A, 73B provided on the base 70 generally constitute bayonet slots. Each slot 73A, 73B comprises a first section 77A which extends generally longitudinally (parallel to the central axis of the base) from the mouth 74A of the slot 73A, 73B. A second section 77B extends generally perpendicularly from the base of the first section 77A, in a circumferential direction along a plane which is perpendicular to the axis of the base 70. A third section 77C extends generally longitudinally from the end of the second section 77B longitudinally (parallel to the central axis of the base 70). Accordingly, the first section 77A of the slot 73A, 73B is generally parallel with the third section 77C of the slot. The slot 73A, 73B may generally be described as being 'Z-shaped'.

To assemble the volume housing 10 on the base 70, a user aligns the first protrusion 16A with the first slot 73A and the second protrusion 16B with the second slot 73B (as described above). The user then moves the volume housing 10 towards the base 70 such that the first 16A and second 16B protrusions travel into the respective mouths 74A, 74B of the first 73A and second 73B slots. The volume housing 10 can continue to be moved axially towards the base 70, until the first 16A and second 16B protrusions abut against the end of the first section 77A of the respective first 73A and second 73B slots. The change in direction between the first 77A and second 77B sections acts as a hard stop. At this point, the user can then rotate the volume housing 10 (about a central axis) relative to the base 70, such that the first 16A and second 16B protrusions travel along the second section 77B of each of the first 73A and second 73B slots. The volume housing 10 can continue to be rotated relative to the base 70 until the first 16A and second 16B protrusions abut the end of the second section 77 of the respective slots 73A, 73B (another hard stop). This action is largely similar to a conventional bayonet fitting.

In the embodiment shown in FIG. 2, the inner source assembly 1 further comprises a resilient element 69, for example a spring 69, which biases the base 70 and volume housing 10 away from one another. Accordingly, in order to insert the first 16A and second 16B protrusions into the first 73A and second 73B slots, a user must apply enough axial manual force which opposes and overcomes the spring force of the resilient element 69. When the volume housing has been inserted into the base 70 such that the protrusions 16A, 16B have travelled down and abutted the end of the first section 77A of each slot 73A, 73B, the user can then rotate the volume housing 10 (whilst still applying an axial force to oppose the spring force of the resilient element 69), such that the protrusions 16A, 16B travel along the second section 77B of the respective slots 73A, 73B. Afterwards, a user may release the volume housing 10, at which point the spring force of the resilient element 69 urges the volume housing 10 away from the base 70. However, because the first 16A and second 16B protrusions are within the second section 77B of the slots 73A, 73B, and the resilient element 69 may not provide any substantial torsional force, separation of the volume housing 10 from the base 70 is prevented. In the embodiment shown, the intersection of the second 77B and third 77C sections further comprises a detent 79 (FIG. 4, 5*b*), in which the first 16A and second 16B protrusions are receivable, to prevent inadvertent rotation of the volume housing 10 with respect to the base 70 which could otherwise release the arrangement. This is similar to a conventional bayonet fitting (save at least for the dissimilar protrusions and/or slots).

The slot 73A, 73B may further comprise a third section 77C which extends from the end of the second section 77B, in a direction generally parallel to the longitudinal axis of the base 70 (and away from the optional detent 79). In use, when the inner source assembly 1 is assembled into and secured to a mass spectrometer housing 200, the wings 13 of the volume housing 10 abut against the heated source block 240 (FIG. 9*a*) of an outer source assembly. Consequently, as the inner source assembly 1 is secured to the housing 200 of the mass spectrometer (FIG. 12), the reactionary force applied by the outer source assembly (specifically the source block 240) on the volume housing 10 causes the volume housing 10 to move axially further towards the base 70, which causes the first 16A and second 16B protrusions of the volume housing 10 to travel along the third section 77C. The third section 77C substantially constrains the volume housing 10 to axial movement relative to base 70. When the inner source assembly 1 is released from the housing of the mass spectrometer, the spring force of the resilient element 69 causes the pins 16A, 16B of the volume housing 10 to be returned to the respective detents 79, at the intersection of the second 77 and third 78 sections.

In the embodiment described, the first 77A, second 77B and third 77C sections of the first slot 73A are generally the same as those of the second slot 73B. This is not essential. The dimensions and/or form of the first slot 73A may differ to those of the second slot 73B. For example, only on the first 73A and second 73B slots may comprise a detent 79.

In at least one embodiment, one or both of the slots 73A, 73B may otherwise be U-shaped or J-shaped.

In the embodiment shown in FIG. 2, the resilient element is a coil spring 69. The opening at the top of the base comprises an axial upstanding tubular boss 80 which is partially received in one end of the coil spring 69. In the embodiment shown, the other end of the coil spring 69 receives part of a repeller assembly 50, as described later. In the embodiment shown, one axial end of the repeller rod of the repeller assembly 50 is receivable in the hollow of the boss 80 in a sliding relationship, such that the repeller assembly 50 (and thus the ionisation chamber 30 and volume housing 10) is constrained to substantially linear movement relative to the base 70.

Although, in the embodiment described, the protrusions 16A, 16B are provided on the volume housing 10 and the slots 73A, 73B are provided on the base 70, this is not essential. The opposite arrangement is possible. In one arrangement, the protrusions may extended inwardly from a female part and be received in a slot provided on the outer surface of a male part.

Repeller Assembly

Another aspect of the present invention provides a repeller assembly 50 comprising a repeller 51 and a repeller holder 55. The repeller 51 comprises a disc 52 portion and a shaft 53 attached to the disc portion 52. The shaft 53 extends generally longitudinally away from the disc portion 52. The plane of the disc portion 52 is generally perpendicular to the axis of the shaft 53.

The repeller holder 55 is generally cylindrical, having a first axial end 56 and a second axial end 57. The repeller holder 55 further comprises an aperture 58 for receiving at least a part of the shaft 53 of the repeller 51. The aperture 58 extends from the first axial end 56 of the repeller holder 55 into the body of the repeller holder 55. In at least one embodiment, the aperture 58 extends from the first axial end 56 to the second axial end 57 (i.e. it is a through hole). The shaft 53 of the repeller 51 and/or the aperture 58 of the repeller holder 55 is configured such that the shaft 53 of the repeller 51 is prevented from rotating relative to the repeller holder 55 when inserted therein. In at least one embodiment, the shaft 53 and/or repeller holder 51 comprise corresponding keying features.

In at least one embodiment, the shaft 53 may only be receivable in the aperture 58 in a single rotational orientation. In at least one embodiment, the shaft 53 of the repeller 51 and/or the aperture 58 of the repeller holder 55 has a single plane of symmetry. Consequently, the shaft 53 of the repeller 51 is only receivable in the aperture 58 in a single rotational orientation. In at least one embodiment, the shaft 53 and/or aperture 58 is non-cylindrical. In another embodiment, the shaft 53 and/or aperture 58 comprises a substantially cylindrical surface provided with at least one flat portion or other protrusion. Any other cross-section can be adopted which provides a single plane of symmetry.

In another embodiment, the shaft 53 of the repeller 51 and/or the aperture 58 of the repeller holder 55 do not have any planes of symmetry, such that the shaft 53 of the repeller 51 is only receivable in the aperture 58 in a single rotational orientation. In one aspect of the present invention, therefore, the shaft 53 of the repeller 51 and/or the aperture 58 of the repeller holder 55 have only one or no planes of symmetry. In other words, there are fewer than two planes of symmetry.

When the repeller shaft 53 is received in the aperture 58 of the repeller holder 55, the distal end of the shaft 53 of the repeller 51 may be proud of the second axial end 57 of the repeller holder 55, or remain within the aperture 58 of the repeller holder 55.

In at least one embodiment, only part of the repeller 51 has one or no planes of symmetry. The disc 52 and/or a substantial part of the repeller shaft 53 may be circular in cross-section. Rather, only a part of the repeller 51 may provide a keying feature to be received and keyed in place by a corresponding part of the repeller holder 55 to prevent rotation.

In another embodiment, the shaft 53 of the repeller 51 and/or the aperture 58 of the repeller holder 55 may have a plurality of planes of symmetry. For example, the shaft 53 may comprise a plurality of circumferentially distributed splines (not shown) which engage with corresponding longitudinal grooves (not shown) in the aperture. In another embodiment, the shaft 53 of the repeller 51 and/or the aperture 58 of the repeller holder 55 may have a square or hexagonal cross section.

The repeller assembly 50 may further comprise a repeller rod 65 which comprises a threaded aperture 66 extending inwardly from a first axial end of the repeller rod 65 for receiving at least a part of the distal end of the shaft 53 of the repeller 51 therein. In at least one embodiment, the distal end of the shaft 53 of the repeller 51 is provided with a thread which mates with the threaded aperture 66 of the repeller rod 65.

To assemble the repeller assembly 50, a user inserts the shaft 53 of the repeller 51 into the repeller holder 55.

Once the repeller 51 is received in the repeller holder 55, the repeller rod 65 may then be offered up to the opposite side of the repeller holder 55 so as to engage the thread of the distal end of the shaft 53 of the repeller 51 with the threaded aperture 66 of the repeller rod 65. If the user grips the outer surface of the repeller holder 55 with one hand, and the outer surface of the repeller rod 65 with their other hand, rotation of the repeller rod 65 relative to the repeller holder 55 causes the distal end of the shaft 53 of the repeller 51 to advance into the repeller rod 65, and to secure the repeller 51, repeller holder 55 and repeller rod 65 together. This is because the repeller 51 is only able to translate linearly with respect to the repeller holder 55 (due to the keying features) and thus rotation of the repeller rod 65 relative to the repeller holder 55 causes the shaft 53 to be drawn into the threaded aperture of the repeller rod 65.

One advantage of such an arrangement is that no tools may be required in order to tighten the repeller assembly, or to ensure the correct alignment of the components. The keying arrangement prevents rotation of the repeller 51 relative to the repeller holder 55 as the repeller rod 65 is secured thereto.

In at least one embodiment, the shaft 53 of the repeller 51 and aperture 58 of the repeller holder 55 comprise substantially the same cross-section. In at least one embodiment, the shaft 53 and/or aperture 58 comprises a substantially cylindrical surface provided with at least one flat portion. However, this arrangement is not essential and any other cross-section presenting keying features may be adopted. For example, at least a part of the repeller shaft 53 may be square in cross-section, which is receivable in a substantially square aperture 58 of the repeller holder 55. In at least one embodiment, the aperture 58 of the repeller holder 55 may be substantially "D-shaped" in cross-section. Nevertheless, in such arrangements, the distal end of the shaft 53 of the repeller 51 is threaded so as to be receivable in the aperture 66 of the repeller rod 65. In at least one embodiment, the repeller holder 55 is comprised of substantially thermally and/or electrically insulating material.

In at least one embodiment, the repeller rod 53 may provide for outgassing of any trapped air between the engaged threads when a vacuum is pulled in the mass spectrometer. In at least one embodiment, the axial end of the repeller rod 53, which is receivable in the repeller holder 55, comprises at least one groove. In at least one embodiment, there may be a diametrical groove across the axial end face, as shown in FIG. 2. The groove allows for fluid communication across the axial end face interface and with the threaded aperture 66, even when screwed in place. A venting aperture may also be provided on the cylindrical shaft of the repeller rod 53 (as shown in FIG. 2), to fluidly connect (and thus vent) the threaded aperture 66 of the repeller rod 53 to the outer surface. There may be two venting apertures, diametrically opposed from one another. Such venting apertures may, in use, be sized to receive a tool (e.g. an Allen key) therethrough so that a user may apply additional torque to the repeller assembly when un/screwing the repeller rod 53.

In another aspect of the present invention, a repeller assembly 50 comprises a thermally and/or electrically insulating repeller holder 55 comprising an aperture 58. The repeller assembly 50 further comprises a repeller 51 received in the aperture 58 of the repeller holder 55. Furthermore, the repeller assembly 50 comprises an ionisation chamber 30 comprising a cavity 31, and the repeller holder 55 is received in the cavity 31 of the ionisation chamber 30 such that the repeller 51 is substantially thermally and/or electrically insulated from the ionisation chamber 30.

In at least one embodiment, the repeller assembly 50 is at least partially receivable in an ionisation chamber 30. The ionisation chamber 30 comprises a cavity 31 which at least partially receives the repeller assembly 50 therein, as shown in the exploded diagram of FIG. 1.

The repeller holder 55 may effectively act as a thermal and/or electrical barrier between the ionisation chamber 30 and the repeller 51. Ionisation efficiency is a function of temperature. In use, the ionisation chamber 30 may be heated to temperatures of or exceeding 150° C. It may be preferable for the ionisation chamber 30 to be thermally insulated to locally confine the heat. The provision of a thermally insulating repeller holder 55 serves to ensure that heat in the ionisation chamber 30 is not unduly dissipated away from the chamber 30. Additionally or alternatively, the ionisation chamber 30 and the repeller 51 are electrically isolated from one another so that they can each be held at different (in at least one embodiment, significantly different) electrical potential from one another. The provision of an electrically insulating repeller holder 55 serves to electrically isolate the repeller 51 and the ionisation chamber 30.

The repeller holder 55 may be comprised of ceramics, glass ceramics, alumina, zirconia or any high temperature engineering polymers, such as PEEK, Vespel™ or Ultem™. In at least one embodiment, the repeller holder 55 may be comprised of a ceramic including Shapal™ or Macor™. In at least one embodiment, the repeller holder 55 may be comprised of a glass ceramic including Zerodur™. In at least one embodiment, the repeller holder 55 is comprised of a high temperature grade Vespel™ material.

Volume Housing and Ionisation Chamber

In one aspect of the present invention, there is provided an ionisation arrangement comprising a volume housing 10 and an ionisation chamber 30. The volume housing 10 comprises an aperture 15. The ionisation chamber 30 has an outer surface 32 and is receivable in the aperture 15 of the volume housing 10. The aperture 15 of the volume housing 10 and/or the outer surface 32 of the ionisation chamber 30 is configured such that the ionisation chamber 30 is only receivable in the aperture 15 of the volume housing 10 in a single rotational orientation.

In at least one embodiment, the aperture 15 and/or outer surface 32 has/have a single plane of symmetry. In at least one embodiment, the aperture 15 and/or outer surface 32 has/have no plane(s) of symmetry. In at least one embodiment, the aperture 15 and/or outer surface 32 has/have only one or no planes of symmetry. Consequently, the ionisation chamber 30 may only be receivable in the aperture 15 of the volume housing 10 in a single rotational orientation.

As shown in FIG. 2. the ionisation chamber 30 is generally cylindrical, and comprises at two apertures 33 in the cylindrical side wall (only one visible) and an aperture 34 in the centre of the axial end face. The size of the aperture 34 in the axial end face and the number of apertures 33 in the cylindrical side wall differs for electron impact (EI) sources and chemical impact (CI) sources. The ionisation chamber 30 for an EI source may comprise a single aperture 33 in the cylindrical side wall. The ionisation chamber 30 for a CI source may comprise two apertures 33, diametrically opposed, in the cylindrical side wall. The apertures 33, 34 of the ionisation chamber for use as a CI source may be larger than the apertures 33, 34 of the ionisation chamber for use as a EI source.

The aperture(s) 33 in the cylindrical side wall of the ionisation chamber 30 are to be aligned, in use, with a filament assembly(ies) 22 (FIG. 6) provided on the volume housing 10. The correct (and repeatable) orientation of the ionisation chamber 30 relative to the volume housing is therefore of importance.

In at least one embodiment, the aperture 15 of the volume housing 10 and/or the outer surface 32 of the ionisation chamber 30 is non-cylindrical. That is to say, although to the casual observer, the ionisation chamber 30 may be generally cylindrical, the surface is not truly cylindrical, and has various features around its circumference which contribute to it having a single or no plane of symmetry.

In at least one embodiment, the aperture 15 of the volume housing 10 and/or the outer surface 32 of the ionisation chamber 30 is substantially cylindrical but provided with at least one flat portion 35. In at least one embodiment, there are two flat portions 35, arranged diametrically opposing one another. In another embodiment, there are three flat portions 35.

In at least one embodiment, the aperture 15 of the volume housing 10 and/or the outer surface 32 of the ionisation chamber 30 comprises substantially the same cross-section. In at least one embodiment, the cross section is substantially "D-shaped".

In at least one embodiment, the outer surface 32 of the ionisation chamber 30 is received with a substantially close fit within the aperture 15 of the volume housing 10, such that the central axis of the aperture 15 of the volume housing 10 is substantially aligned with the central axis of the outer surface 32 of the ionisation chamber 30.

In another aspect of the invention, the outer surface 32 of an ionisation chamber 30 for use with an EI source may be different to the outer surface 32 of an ionisation chamber 30 for use with a CI source. Likewise, the volume housings 10 may be different depending on the ionisation chamber 30 to be used. The aperture 15 of a volume housing 10 for use with an EI source may be sized only to receive the EI ionisation chamber 30, and the aperture 15 of a volume housing 10 for use with a CI source may be sized only to receive the CI ionisation chamber 30. An EI ionisation chamber 30 may have a different number and/or configuration of flats 35 on its outer surface 32 than a CI ionisation chamber 30. Alternatively or additionally, the dimension of the flat(s) 35 on the EI ionisation chamber may differ to those of a CI ionisation chamber.

The volume housings 10 may differ for each application. For example, only a single filament assembly may be attached to a volume housing 10 for use with a CI source, but two filament assemblies may be attached to a volume housing 10 for use with an EI source.

In one aspect of the present invention, there is provided an ionisation arrangement kit, comprising:

- a first volume housing 10 comprising an aperture 15 of a first cross-section;
- a second volume housing 10 comprising an aperture 15 of a second cross-section;
- a first ionisation chamber 30 having an outer surface 32 substantially corresponding to the first cross-section; and
- a second ionisation chamber 30 having an outer surface 32 substantially of the second cross-section, wherein the first and second cross-sections are dissimilar such that only the first ionisation chamber 30 is receivable in the aperture 15 of the first volume housing 10 and only the second ionisation chamber 30 is receivable in the aperture 15 of the second volume housing 10.

A source block 240 of, or suitable for use with, any of the embodiments disclosed herein may be comprised of aluminium, which has been found to provide optimal electrical and thermal conductivity whilst preventing material bonding/stiction at prolonged high temperatures.

A volume housing 10 of, or suitable for use with, any of the embodiments disclosed herein may be comprised of aluminium bronze.

An ionisation chamber 30 of, or suitable for use with, any of the embodiments disclosed herein may be comprised of stainless steel.

In use, the ionisation chamber 30 needs to be heated, but it can be problematic to attempt to heat the ionisation chamber 30 directly. Accordingly, the source block 240 may be heated, and the volume housing 10 therebetween acts a thermal bridge. The wings 13 of the volume housing 10 illustrated in FIG. 2 serve to maximise thermal contact between the volume housing 10 and source block 240 in use. In at least one embodiment, the ionisation chamber 30 is received in the aperture 15 of the volume housing 30 with a substantially tight or sliding fit, so as to conduct heat from the volume housing 10 into the ionisation chamber 30.

In at least some embodiments, the volume housing 10 and source block 240 may be composed of dissimilar materials. The use of dissimilar materials for the volume housing 10

(e.g. aluminium bronze) and source block 240 (e.g. aluminium) reduces the chances of the two components sticking (bonding or fusing) together at high temperatures. Nevertheless, the high thermal and electrical conductivity of aluminium are similar to those of aluminium bronze, and thus the volume housing 10 and source block 240 may both still serve as efficient heat conductors in use to heat the ionisation chamber 30.

Inner Source Assembly with Electrical Terminals

In another aspect of the present invention, as illustrated in FIGS. 6 to 9 there is provided an inner source assembly 1 for a mass spectrometer. The assembly comprises a repeller 51, at least one filament assembly 22 and an inner source interface panel 91. In at least one embodiment, there may be two filament assemblies 22.

The inner source interface panel 91 comprises a plurality of terminals 92 electrically connectable to the repeller 51 and the at least one filament assembly 22. The plurality of terminals 92 are for electrical connection with corresponding terminals 202 of a mass spectrometer interface panel 201 on a mass spectrometer housing in use.

The plurality of terminals 92 are preferably linearly aligned in an array across the inner source interface panel 91.

In one aspect of the present invention, there is provided a mass spectrometer assembly comprising the inner source assembly 1 and a mass spectrometer housing 200 for receiving the inner source assembly 1. The mass spectrometer housing 200 comprises a mass spectrometer interface panel 201 comprising a plurality of corresponding terminals 202. The mass spectrometer assembly 200 is configured such that when the inner source assembly 1 is received in the mass spectrometer housing 200, the terminals 92 of the inner source interface panel 91 electrically contact the corresponding terminals 202 of the mass spectrometer interface panel 201. The connection may be made for the transfer of power, electricity and/or control signals from or between the mass spectrometer 200 and/to the inner source assembly 1.

In an embodiment of the inner source assembly 1 comprising two filament assemblies 22, there are five terminals 92; two per filament assembly 22 and one for the repeller 51. In an embodiment of an inner source assembly 1 comprising only one filament assembly 22, there may be fewer terminals 92 (e.g. 3). In another embodiment, regardless of the number of filament assemblies 22, there may be the same number of terminals 92, but some may be redundant, not connected or blanked off.

In at least one embodiment, the terminals 92 are equally spaced across the source interface panel 91. The spacing and/or layout of the terminals 202 on the mass spectrometer interface panel 201 may be substantially identical to those on the source interface panel 91.

In the embodiment illustrated, the plurality of terminals 92 on the inner source interface panel 91 comprise a plurality of resilient pins. A resilient pin may comprise an elongate contact pin mounted for linear translation in a body, with a spring element provided in the body to bias the contact pin out of the body. The terminals 202 on the mass spectrometer interface panel 201 comprise contact pads to electrically contact the resilient pins 92. In at least one embodiment, the resilient pins are pogo pins.

A benefit of the arrangement is that, as the inner source 1 is assembled in and secured to the mass spectrometer 200, electrical connections are effectively automatically made between the mass spectrometer 200 and the components of the inner source assembly 1 (e.g. the filament assembly(ies) and the repeller).

In at least one embodiment, the terminals 202 on the mass spectrometer interface panel 201 comprise contact pads. In at least one embodiment, the terminals 202 may be arranged in depressions which are sized such that the average user's fingers cannot fit into the recess and inadvertently contact one of the contact pads 202. This arrangement may reduce the chances of a user accidently contacting a live contact, which could cause injury to the user and/or damage to the apparatus. In at least one embodiment, recessing the terminals 202 to prevent inadvertent contact with an operator is not necessary since the power supply to the terminals 202 may be isolated by a separate interlock. For example, an interlock safety system may isolate power to the terminals 202 upon venting of the instrument. Therefore, by the time a user could potentially inadvertently touch the terminals 202 (when the instrument would inherently be vented), the terminals 202 would already be isolated.

The use of resilient pins for the terminals 92 on the inner source interface panel 91 ensures that as the inner source 1 is inserted into the mass spectrometer 200, the resilient pins 92 reliably engage with the contact pads 202. The resilient element (e.g. spring) inside the resilient pin 92 causes the end of the pin to apply a force to the pad 202 to ensure good electrical contact.

The distal ends of the terminals 92 (e.g. pins) may be shaped to promote a good electrical contact. For example, the distal ends may be flat, domed or otherwise non-planar to ensure an adequate point of contact in at least one location of the electrical interface. The terminals 92, 202 may be at least partially comprised of gold or be gold-plated.

When the inner source assembly 1 is removed from the mass spectrometer 200, contact between the terminals 92, 202 is broken and the spring force in the resilient pins 92 causes the pin members to extend outwardly from the resilient pin housing.

Alternatively, the mass spectrometer interface panel 201 may comprise resilient pins and the inner source interface panel may comprise contact pads, or a combination thereof.

In the embodiment illustrated, the terminals 92, 202 of a respective interface panel 91, 201 are substantially identical to one another. This is not essential. They may be of different sizes. For example, power terminals may be bigger, or comprise a different material, than terminals intended to transfer data signals.

Inner Source Assembly with Biasing Element

Figure 10A:
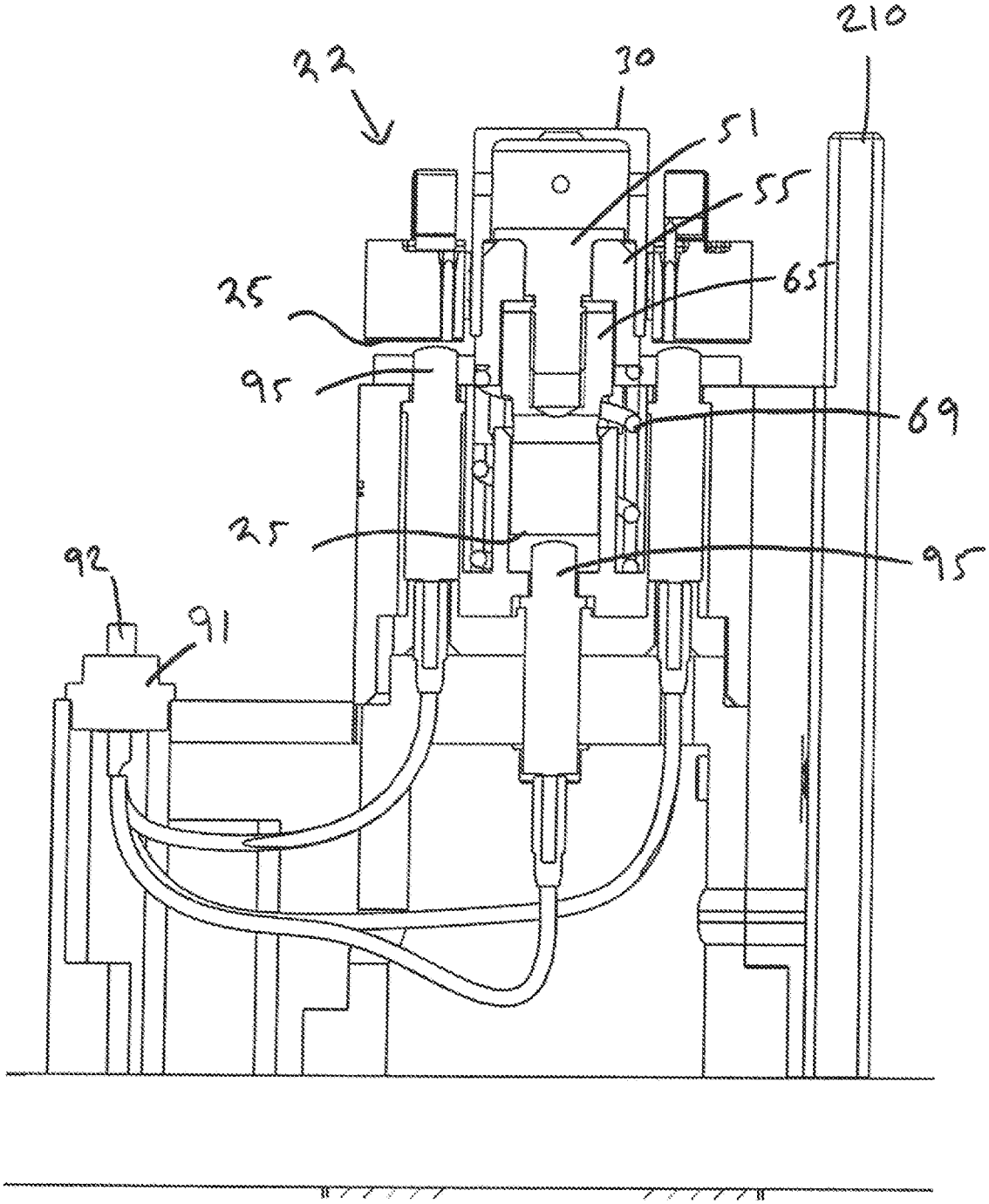
FIG. 10*a* illustrates the arrangement of the inner source assembly prior to insertion into a mass spectrometer housing.
Figure 10B:
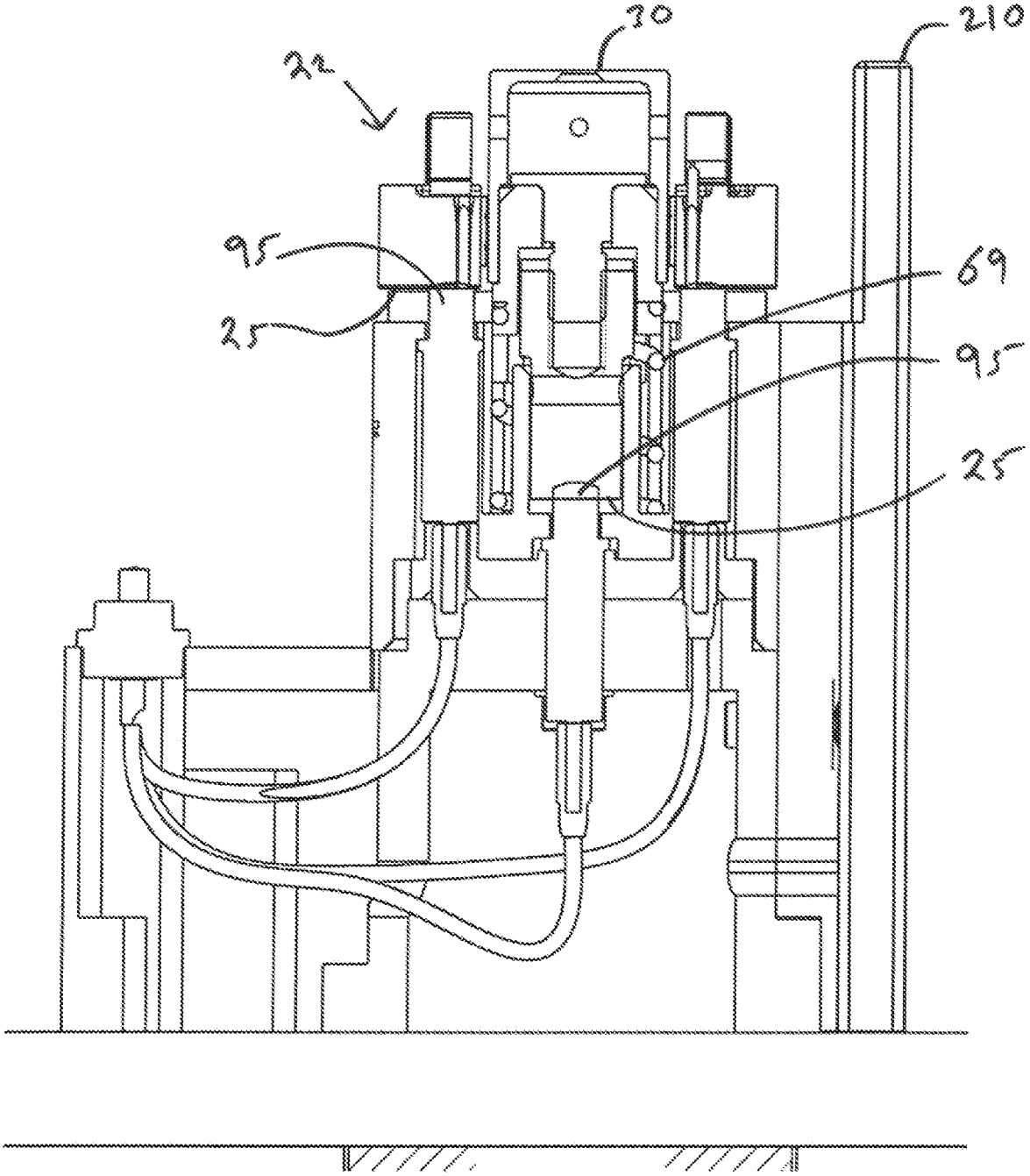
FIG. 10*b* illustrates the arrangement of the inner source assembly after insertion into a mass spectrometer housing.
Figure 11:
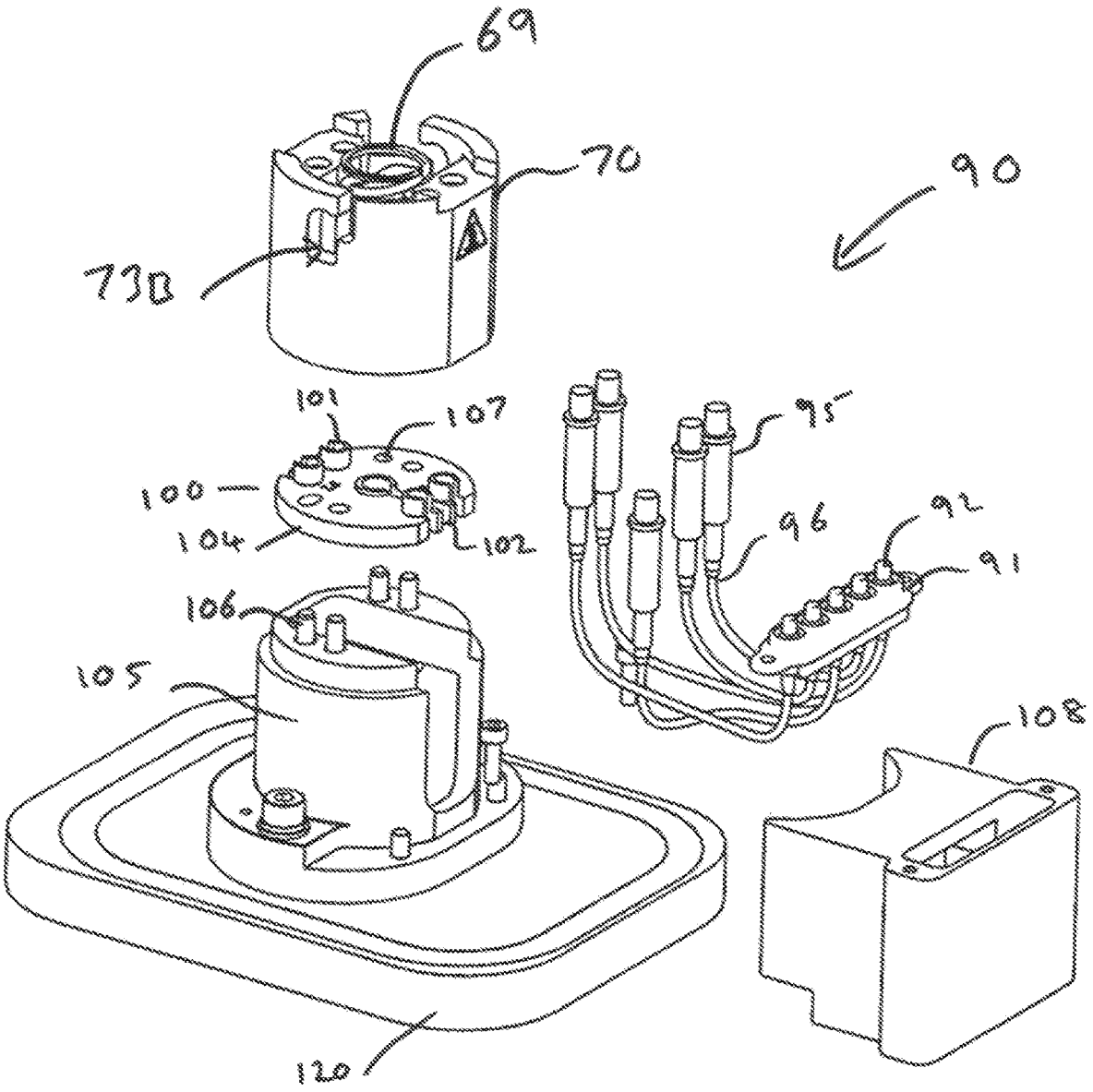
FIG. 11 shows an exploded view of the wiring assembly of an inner source assembly.

Referring to FIG. 1, 10 and the exploded view of FIG. 11 in one aspect of the present invention, there is provided an inner source assembly 1 for a mass spectrometer 200 comprising a base 70 and a volume housing 10. The base 70 comprises a plurality of electrical terminals 95. The volume housing 10 is movably retained on the base 70 for retaining a repeller assembly 50 and ionisation chamber 30 therebetween. The volume housing 10 further comprises or otherwise supports a plurality of corresponding electrical terminals 25. The volume housing 10 is movable between a first axial position relative to the base 70 in which the respective electrical terminals 95, 25 are not connected to one another (shown in FIG. 10*a*); and a second position relative to the base 70 in which the respect electrical terminals 95, 25 are connected to one another (shown in FIG. 10*b*). Furthermore, the inner source assembly 1 comprises a biasing element 69 urging the volume housing 10 into the first position (i.e. away from the second position).

A benefit of this arrangement is that, when the inner source assembly 1 is not installed in and secured to a mass spectrometer housing 200, the terminals 95, 25 are not connected between the base 70 and the volume housing 10.

In an embodiment where the terminals 95, 25 of at least one of the base 70 and volume housing 10 comprise resilient pins, this serves to avoid damage/fatigue to the springs of the resilient pins. In at least one embodiment, the distance of axial travel between the first and second axial positions of the volume housing 10 relative to the base 70 is larger than the maximum travel of the resilient pins, such that when the volume housing 10 is urged into the first position by the biasing element 69, the volume housing 10 is clear from contact with the distal ends of the resilient pins.

The terminals 95 of the base 70 are, in at least one embodiment, provided generally on an interface surface, or surfaces, of the base 70. Likewise, the electrical terminals 25 of the volume housing 10 (or supported thereby) are provided on a corresponding interface surface. In at least one embodiment, the surfaces are substantially planar and perpendicular to the longitudinal axis of the base 70 and volume housing 10. When the volume housing 10 is movably retained relative to the base 70, the respective interface surfaces 95, 25 face one another. In at least one embodiment, the electrical terminals 95 of the base 70 comprise resilient pins; and at least one of the electrical terminals 25 of (or supported by) the volume housing 10 comprise contact pads. The pads are distributed across the interface surface(s) of the volume housing 10 in the same pattern as the distribution of the resilient pins 95 on the base 70, such that when the volume housing 10 and base 70 are coaxially aligned, the resilient pins 95 are correspondingly axially aligned with the corresponding pad 25. In addition to this arrangement serving to reduce or avoid damage to the springs and resilient pins, it may also serve to avoid, or reduce, excessive and unnecessary wear and tear of the contact pads.

In the embodiment illustrated in FIG. 10, the electrical terminals 25 of the volume housing 10 may not be provided by or on the volume housing itself but, rather, by components or assemblies mounted on or associated with the volume housing 10. For example, in FIGS. 10*a* and 10*b*, the electrical terminals 25 may be provided on the base of the housing of the filament assembly 22. Similarly, the electrical terminal 95 on the base 70 for connection to the repeller may engage directly with a part of the repeller assembly 50. The electrical terminal 95 may contact the repeller rod 65. Accordingly, the base of the repeller rod 65 therefore acts as a terminal 25 of the volume housing 10.

The volume housing 10 is caused to be urged towards the base, into the second position such that the terminals 95, 25 connect to one another, when the inner source assembly 1 is secured in the mass spectrometer housing 200. As the inner source assembly 1 is inserted, the wings 13 of the volume housing 10 engage against the surface of the heater block 240.

Wiring Assembly

In one aspect of the present invention, there is provided a wiring mounting plate 100 (FIG. 11). The mounting plate 100 comprises a plurality of apertures 101, each to receive a terminal connector 95 of a corresponding plurality of wires 96 in use. The apertures 101 are configured to retain the terminal connectors 95 in a substantially parallel configuration.

In at least one embodiment, the mounting plate 100 is generally circular, and comprises an array of apertures 101 across its surface. In at least one embodiment, the mounting plate 100 further comprises a plurality of channels 102, connecting a respective aperture 101 to the outer radial surface 104 of the mounting plate 100, for the insertion of a wire 96.

In at least one embodiment, a plurality of wires 96 are assembled onto the mounting plate 100. Each wire 96 is connected at a first end to a terminal connector 95, and a second end to a terminal 92 on an inner source interface panel 91 (described above).

In at least one embodiment, the terminal connector 95 is a resilient pin, comprising a main, substantially rigid, body with an aperture and receiving a spring mounted pin therein. The outer diameter of the body is larger than the diameter of the wire 96. In at least one embodiment, the width of the channel 102 is narrower than the diameter of the aperture 101. In at least one embodiment, the diameter of the body of the terminal connector 95 is larger than the diameter of the wire 96. In at least one embodiment, the width of the channel 102 is smaller than the diameter of the body of the terminal connector 95. In at least one embodiment, the mounting plate 100 is comprised of a substantially electrically and/or thermally insulating material. In at least one embodiment, the material may be PEEK.

To assemble the wiring assembly 90, the user takes the mounting plate 100 and inserts and assembles, in turn, each of a plurality of wires 96. The wire 96 of the first connector 95 is offered up to the channel 102 of the mounting plate 100, and moved inwardly until it reaches the aperture 101. When the wire 96 is received in the aperture 101, a user can move it axially within the aperture 101 until the terminal connector 95 contacts the wiring plate 100. The terminal connector 95 may be fitted into the aperture 101 to substantially prevent movement. In at least one embodiment, at least some of the apertures 101 of the mounting plate 100 comprise an upstanding boss which is sized so as to receive at least a part of the bottom end of the terminal connector 95. In at least one embodiment, a part of the mounting plate 100 adjacent to each aperture 101 effectively comprises a socket to receive, with a substantially tight fit, the cylindrical end of the terminal connector 95. Consequently, the terminal connector 95 is then robustly mounted on the mounting plate 100, with the wire 96 trailing below. By configuring the dimensions of the mounting plate 100 and/or the body of the terminal connector 95, the distance between the upper surface of the mounting plate 100 and the distal end of the terminal connector 95 is predetermined and repeatable.

In at least one embodiment, as shown in FIG. 11, the mounting plate 100 is received on a wiring base 105 which, in turn, is secured to a sealing plate 120. The mounting plate 100 and/or the wiring base 105 may comprise at least one alignment protrusion 106 which is received in a corresponding alignment aperture 107 on the other of the mounting plate 100 or wiring base 105. This is to ensure that the mounting plate 100 is mounted onto the wiring base 105 substantially aligned coaxially. The wiring base 105 is at least partially hollow so as to receive the plurality of wires 96 therein, as shown in FIG. 11. The assembly 90 further comprises an interface panel mounting 108 for securement to the wiring base 105 and to receive and retain the inner source interface panel 91.

In at least one embodiment, once the plurality of wires 96 are installed on the mounting plate 100, and the assembly mounted onto the wiring base 105, the assembly is then received within an aperture at the bottom of the ionisation chamber base 70. In at least one embodiment, the length of the wires 96 is configured to be different lengths and/or colour coded, such that a user will readily visually establish where the wires 96 are to be assembled on the wiring mount.

In at least one embodiment, the wires 96 are comprised of high temperature grade material, such as Teflon™. This prevents damage to the wire 96 and/or ensures the effective operation the terminals 95 (e.g. pogo pins) The apertures 101 of the wiring mount 100 may be of different diameters and/or cross sections, such that no aperture 101 is the same as another aperture 101. Likewise, the terminal connectors 95 may be correspondingly shaped, to ensure that a terminal connector 95 may only be receivable in a predetermined aperture 101. This enables substantially fool-proof assembly.

The wiring mounting plate and/or the wiring base 105 serve to conceal the wires 96, to avoid damage thereto, to ease assembly and/or to increase the aesthetic appeal of the arrangement. Concealing the wires 96 substantially prevents a force being imparted on a wire 96 which could otherwise cause an electrical terminal 95 (e.g. a pogo pin) to be misaligned relative to the mounting plate 100. If the axis of linear translation of the pogo pin 95 is misaligned with the longitudinal axis of the assembly, it could be caused to stick or jam in use.

Mass Spectrometer Rail

Figure 12A:
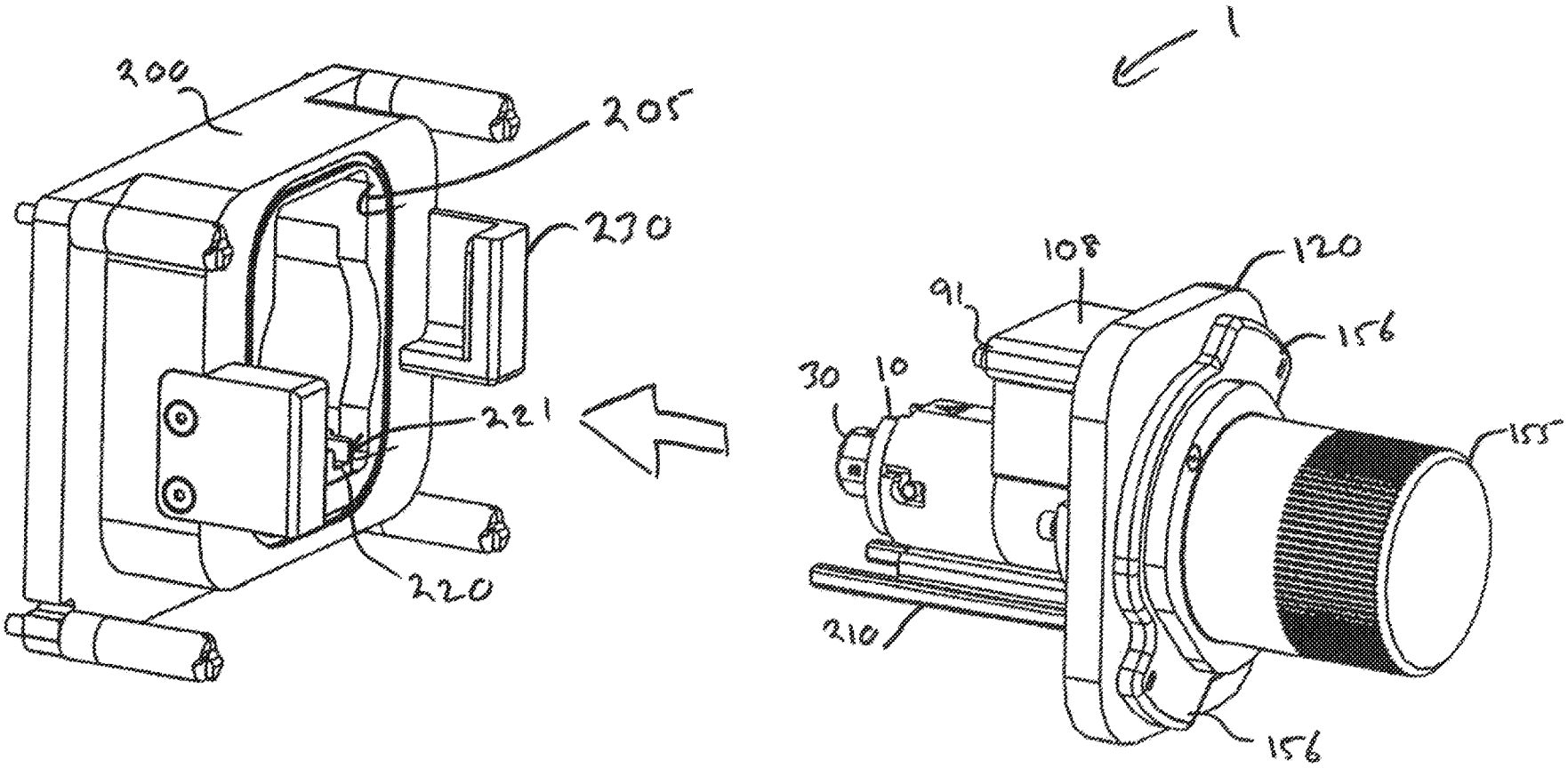
FIG. 12*a* illustrates the rail and channel arrangement of an inner source assembly and mass spectrometer.

Referring to FIG. 12*a*, in one aspect of the present invention, there is provided a mass spectrometer assembly comprising an inner source assembly 1 and a mass spectrometer housing 200. The mass spectrometer housing 200 has an aperture 205 for receiving the inner source assembly 1 therein. One of the inner source assembly 1 and mass spectrometer housing 200 comprises at least one rail 210 and the other of the mass spectrometer housing 200 and inner source assembly 1 comprises at least one channel 220 for receiving said at least one rail 210.

In the embodiment, the mass spectrometer housing 200 comprises two channels 220 provided on the inner radial surface of the aperture 205 thereof, and the inner source assembly 1 comprises two rails 210. In FIG. 12*a*, only one channel 220 is visible. In at least one embodiment, the channels 220 are spaced from one another. The spacing may be 30 mm.

In at least one embodiment, the opposing side surfaces of the rail 210 and/or opposing side surfaces of the channel 220 are not parallel to one another. In at least one embodiment, the side surfaces of the rails 210 and/or opposing side surfaces of the channel 220 are non-linear.

In the embodiment illustrated, each channel 220 extends from a first end 221, adjacent the exterior of the mass spectrometer housing 200, to a second end 222, adjacent the interior of the mass spectrometer housing 200. The first end 221 of each channel 220 effectively constitutes a "mouth" into which each rail 210 is received.

In at least one embodiment, the width of a channel 220 at the first end 221 is wider than the width of the channel 220 at the second end 222.

In at least one embodiment, the side surfaces of the channel 220 at the first end 221 of the channel 220, (the mouth) are not parallel to one another. In at least one embodiment, they are angled to one another by at least a few degrees. The side surfaces of the channel 220 at the second end 222 of the channel 220, adjacent the interior, may be substantially parallel to one another. A benefit of the rail 210 and channel assembly 220 is that the inner source assembly 1 is substantially guided and supported during its insertion into the mass spectrometer housing 200. As the distal end of the rail 210 engages in the mouth of the channel 221, it serves to guide the inner source assembly 1 into the mass spectrometer housing 200 whilst reducing the risk of the delicate components of the inner source housing 1 hitting the sides of the aperture 205 of the mass spectrometer housing 200, or other components within the mass spectrometer housing 200.

Moreover, the arrangement may reduce the need for the operator to accurately 'aim' the inner source assembly into the mass spectrometer housing.

In at least one embodiment, the rails 210 extend to a point generally in line with the axial end face of the ionisation chamber 30. This may serve to protect the components (particularly the ionisation chamber 30) of the inner source assembly from impacts when an operator places it on a surface (e.g. for storage or cleaning). The rails 210 may extend beyond the axial end face of the ionisation chamber 30.

Figure 12B:
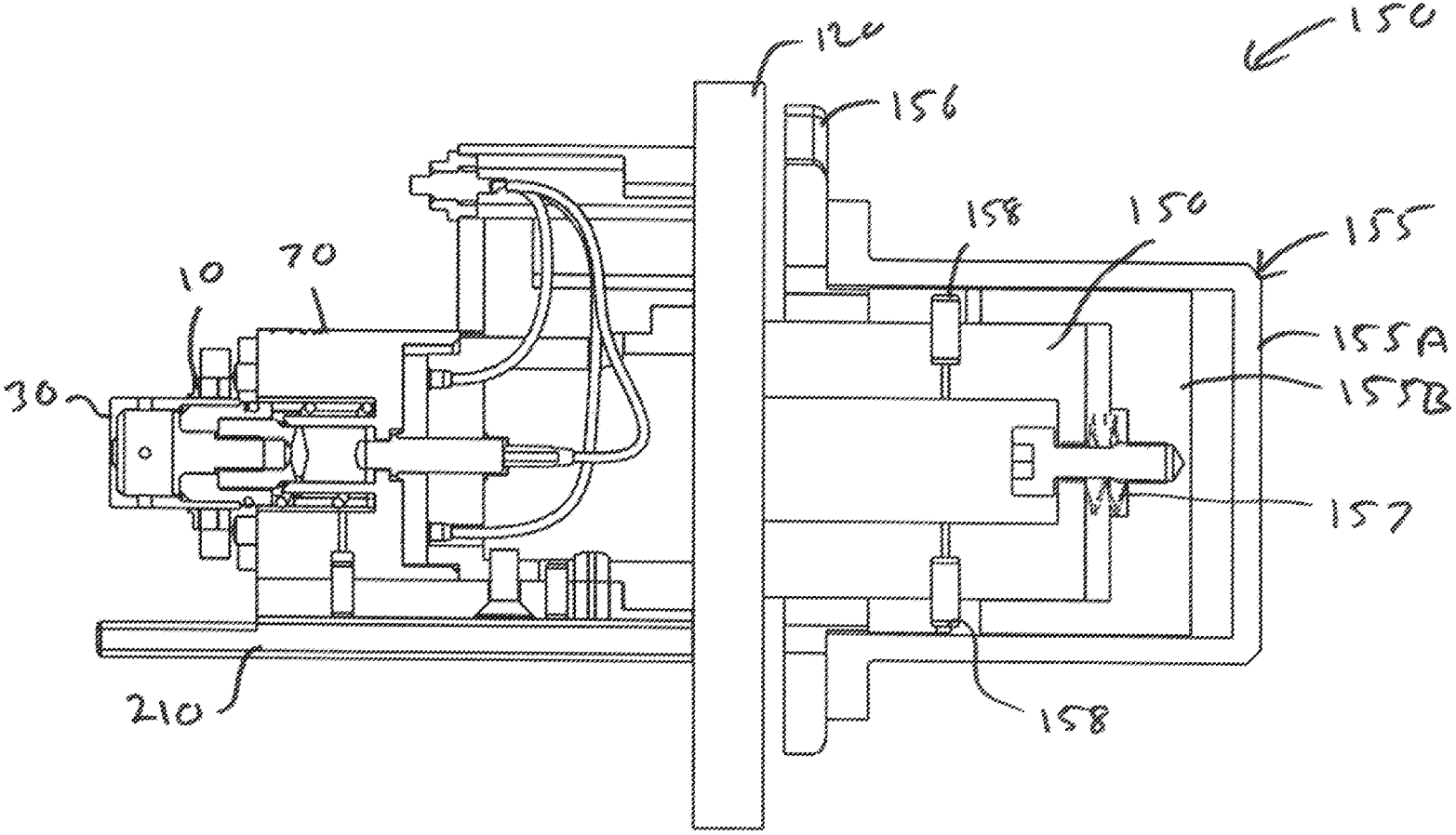
FIG. 12*b* illustrates a cross-section of the inner source assembly of FIG. 12*a;*
Figure 12C:
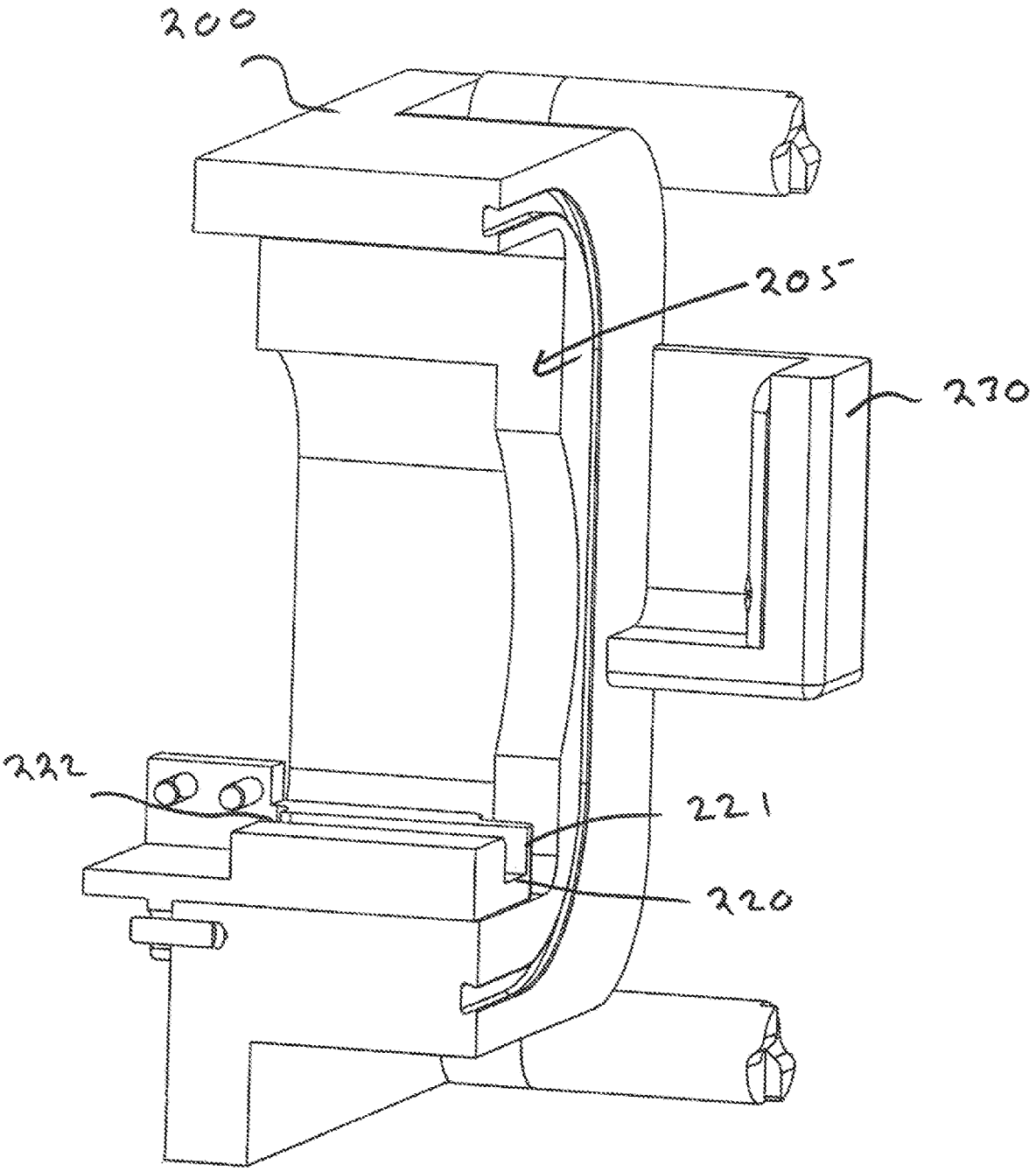
FIG. 12*c* illustrates a cut-away view of the mass spectrometer housing shown in FIG. 12*a*.

With reference to FIG. 12*b*, the mass of the components to the left side (i.e. vacuum side) of the sealing plate 120 may be higher than the mass of the components to the right side (i.e. atmospheric side) of the sealing plate 120, such that placing the inner source assembly on a surface will naturally cause it to pivot about the base of the sealing plate (counter-clockwise in the view of FIG. 12*b*). The rails 210 effectively serve as 'feet' when the inner source assembly is placed on a surface.

Although in the embodiments shown there are two rails 210 and two channels 220, this is not essential. In at least one embodiment, there is a single channel 220 and single rail 210.

Handle Assembly

One aspect of the present invention provides an inner source handle assembly 150 for a mass spectrometer comprising a main body 151 attached to a sealing plate 120 and a handle 155 rotatably mounted to the main body. The handle 155 comprises at least two radially extending wings 156. The handle 155 is generally cylindrical with a hollow cavity which receives the main body 151 therein.

The handle 155 is movable between a first position spaced from the sealing plate 120, and a second position in which the handle 155 (and/or the wings 156) substantially contacts the surface of the sealing plate 120. A resilient element 157 biases the handle 155 into the first position. The first and second positions are axially spaced from one another.

In the embodiment illustrated (see FIG. 12*b*), the handle 155 comprises an assembly of an outer part 155A and an inner part 155B. Both are generally cylindrical, and the inner part 155B is receivable in the outer part 155A. The inner part 155B may be secured within the outer part 155A. The outer surface of the outer part 155A may be provided with knurling or any other surface dressing or material to add grip with an operator's hand.

In the embodiment illustrated, the wings 156 are provided on the inner part 155B. Alternatively, they may be provided on the outer part 155A. The provision of a two part (outer part 155A and inner part 155B) handle assembly 155 is not essential, but aids manufacture and assembly. The features of the two-part handle assembly 155 described and illustrated herein may alternatively be provided by a single part.

Figure 13:
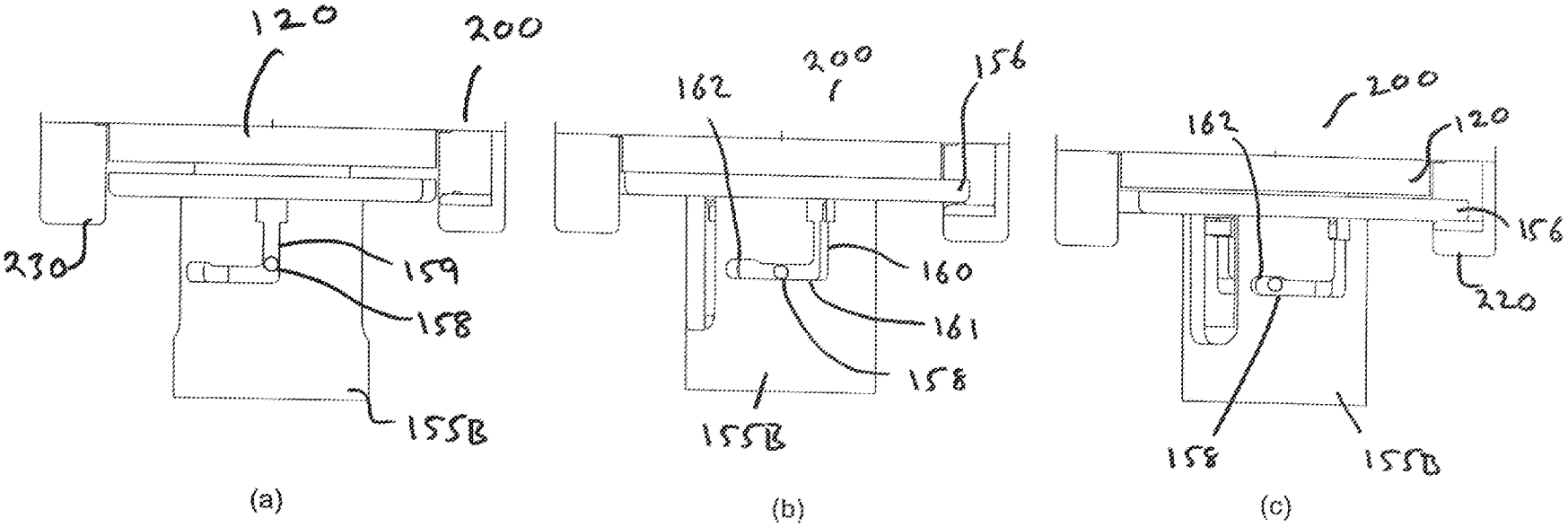
FIGS. 13(*a*) to (*c*) illustrates the engagement of a handle portion with a socket of the mass spectrometer housing.

In FIG. 13, the outer part 155A has been removed, to aid illustration of the features on the inner part 1558.

The main body 151 comprises two diametrically opposed protrusions 158 (see FIG. 12*b*) which are received in corresponding slots 159 provided on the inner part 1558 (see FIG. 13).

The main body 151 of the inner source handle assembly is generally cylindrical. The inner part 155A of the handle 155 has at least a generally cylindrical aperture, into which the cylindrical main body 151 is received. The slot 159 comprises a longitudinal first section 160 to constrain movement of the handle 155 relative to the main body 151 in a longitudinal direction. In at least one embodiment, the slot 159 further comprises a second section 161 substantially perpendicular to the first section 160, constraining the handle 155 to rotational movement relative to the main body 151.

In use, after a user inserts the inner source assembly 1, comprising the inner source handle assembly 150, into a mass spectrometer housing 200, the user applies an axial force to the handle 155, which serves to overcome the spring force of the resilient member 157 which biases the handle 150 into the first position. Consequently, the protrusion 158 on the main body 150 of the inner source handle 150 rides in the slot 159. When the user has applied such a force that the handle 155 has translated to a second position relative to the main body 151 (and contacting the sealing plate 120), the user can then turn the handle 155 relative to the main body 151 such that the protrusion 158 rides into the second section 161 of the slot.

Alternatively, the inner part 155*b* could comprise at least one protrusion 158 and the main body 151 could comprise at least one corresponding slot 159 to receive the protrusion. In either configuration, there could be only a single protrusion and a single slot.

A mass spectrometer housing 200, which may receive the inner source handle assembly, comprises an aperture 205 for receiving the inner source assembly 1. The housing 200 comprises at least two sockets 230 adjacent the aperture 205 to receive the wings 156.

In at least one embodiment, when the user first offers up the inner source assembly 1 to the mass spectrometer housing 200, the radially extending wings 156 of the handle 155 are rotationally offset from the sockets 230 on the mass spectrometer housing 200. The handle 155 can therefore be moved axially towards the sealing plate 120 of the main body 151, without the radially extending wings 156 impacting on the sockets 230 on the mass spectrometer housing 200 (see FIG. 9*a*). When the handle 155 reaches the second position, the user can then rotate the handle 155, which causes the radially extending wings 156 to be received in the sockets 230 on the mass spectrometer housing 200. The interfacing surfaces of one or both of the radially extending wings 156 and the sockets 230 may comprise a camming surface. As the handle 155 is rotated with respect to the main body 151, the inside surface of the sockets 230 on the mass spectrometer housing 200 may provide a camming force on the radially extending wings 156 of the handle 155, which urges the sealing plate 120 of the main body 151 into contact with the mass spectrometer housing 200 to create a seal therewith (see FIG. 13*b*).

The surfaces of one or both of the radially extending wings 156 and the sockets 230 may comprise a friction reducing or low friction material, which may comprise bulk material or a coating. The material may, for example, be PTFE.

In at least one embodiment, at the end of the second section 161 of the slot 159 in the handle 155, there is a transition into a third section 162 which is axially displaced from the second section 161. The slot 159 is generally "J-shaped". When the protrusion 158 on the main body 151 is received into the third section 162 of the slot, some of the force of the handle 155 on the main body 151 is released (See FIG. 13*c*). A benefit of this arrangement is that it reduces the force being applied to the springs and/or seals in the arrangement.

In at least one embodiment, at least one of the interfacing surfaces of at least one wing 156 and at least one corresponding socket 230 comprises a ball plunger and the other of the interfacing surfaces of at least one socket 230 and at least one corresponding wing 156 comprises a depression to receive the ball plunger. As the interface surface of the wing 156 first makes sliding contact with the interface surface of the socket 230, the ball plunger is caused to be depressed (against the force of the spring element within). When the handle assemble 155 is rotated to its maximum extent, such that the wings are received fully within each socket 230, the ball socket is then aligned with the protrusion on the opposing interface surface. The spring force of the resilient element causes the ball plunger to extend. In doing so, the ball plunger makes an audible sound (e.g. a 'click') which serves to inform a user that the wings 156 are fully engaged in the sockets 230. The spring force of the ball plunger urging the ball plunger element into the corresponding depression may also serve to provide at least some initial resistance to the handle 155 being turned to disengage the wings 156 from the sockets 230.

Accordingly, there is provided a mass spectrometer assembly comprising:

- a source assembly comprising a rotatable handle, the handle comprising at least two radially extending wings,
- a mass spectrometer housing comprising at least two corresponding sockets to receive the wings,
- wherein the surface of at least one of the wings or sockets comprises a biased protrusion (e.g. a ball plunger), and the surface of a corresponding one of the sockets and wings comprises a depression to receive the end of the biased protrusion when the wings are received in the sockets.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An inner source assembly for a mass spectrometer, the inner source assembly comprising:

- a base; and
- a volume housing removably connectable to the base for retaining a repeller assembly therebetween,
- wherein the volume housing comprises a first protrusion and a second protrusion and the base comprises a first slot and a second slot to receive and retain the first protrusion and the second protrusion, respectively,
- wherein the first protrusion is longer than the second protrusion, and a guard is associated with a mouth of the second slot, presenting an inner radial surface, and the distance between the inner radial surface and a longitudinal axis of the base is greater than a length of the second protrusion and smaller than a length of the first protrusion.

2. An inner source assembly according to claim 1, wherein the first protrusion has a greater width than the second protrusion.

3. An inner source assembly according to claim 1, wherein a proximal end of each of the first protrusion and the second protrusion is threaded and received in a threaded aperture in the base or the volume housing, wherein a thread on the proximal end of the first protrusion is different to a thread on the proximal end of the second protrusion.

4. An inner source assembly according to claim 3, wherein the thread on the proximal end of the first protrusion is clockwise and the thread on the proximal end of the second protrusion is counter clockwise.

5. An inner source assembly according to claim 3, wherein a pitch of the thread on the proximal end of the first protrusion is different to a pitch of the thread on the proximal end of the second protrusion.

6. An inner source assembly according to claim 1, wherein the first and second protrusions are integrally formed on the volume housing.

7. An inner source assembly according to claim 1, wherein the first and second slots extend longitudinally from an axial end face of the volume housing or the base and each slot comprises a mouth.

8. An inner source assembly according to claim 1, wherein a mouth of a first slot is wider than the first protrusion and narrower than the second protrusion.

9. An inner source assembly according to claim 1, wherein the base comprises a female part and the volume housing comprises a male part at least partly receivable in the female part of the base.

10. An inner source assembly according to claim 1, wherein at least an upper portion of the base is generally cylindrical and comprises a wall in which the first and second slots are provided.

11. An inner source assembly according to claim 1, wherein the first and second slots are generally L-shaped bayonet slots.

12. An inner source assembly according to claim 1, wherein each of the first and second slots comprises a first section extending generally longitudinally, a second section extending generally perpendicularly to the first section, and a third section extending generally longitudinally, wherein the second section further comprises a detent.

13. An inner source assembly according to claim 1, further comprising a resilient member to bias the base and the volume housing away from one another.

14. An inner source assembly according to claim 1, wherein the first and second protrusions are pins.

15. An inner source assembly according to claim 1, wherein the volume housing comprises an aperture and the inner source assembly further comprises an ionisation chamber having an outer surface and being receivable in the aperture, wherein the aperture and/or the outer surface is configured such that the ionisation chamber is only receivable in the aperture in a single rotational orientation.

16. An inner source assembly according to claim 1, further comprising:

a repeller;

at least one filament assembly; and an inner source interface panel comprising a plurality of terminals electrically connectable to the repeller and the at least one filament assembly, the terminals for electrical connection with corresponding terminals on a mass spectrometer housing in use.

17. An inner source assembly according to claim 1, wherein the base comprises a plurality of electrical terminals; and the volume housing is movably retained on the base for retaining the repeller assembly therebetween and comprising a plurality of corresponding electrical terminals, the volume housing movable between a first axial position relative to the base in which the respective electrical terminals are not connected, and a second position relative to the base in which the respective electrical terminals are connected to one another, the inner source assembly further comprising a biasing element urging the volume housing into the first position.

18. An inner source assembly according to claim 1, further comprising:

a mass spectrometer housing having an aperture for receiving the inner source assembly therein, wherein one of the inner source assembly and the mass spectrometer housing comprises at least one rail and the other of the mass spectrometer housing and the inner source assembly comprises at least one channel for receiving the at least one rail.

19. An inner source assembly according to claim 1, further comprising:

a main body comprising a sealing plate;

a handle rotatably mounted to the main body and comprising at least two radially extending wings, the handle movable between a first position spaced from the sealing plate and a second position in which the handle substantially contacts the sealing plate; and a resilient element biasing the handle into the first position.

20. An inner source assembly according to claim 1, further comprising:

a rotatable handle comprising at least two radially extending wings; and a mass spectrometer housing comprising at least two corresponding sockets to receive the wings, wherein the surface of at least one of the wings or the sockets comprises a biased protrusion, and the surface of a corresponding one of the sockets and the wings comprises a depression to receive the end of the biased protrusion when the wings are received in the sockets.

* * * * *